US008231455B2

(12) United States Patent
Walker et al.

(10) Patent No.: US 8,231,455 B2
(45) Date of Patent: Jul. 31, 2012

(54) METHOD AND APPARATUS FOR PROVIDING A BONUS TO A PLAYER

(75) Inventors: Jay S. Walker, Ridgefield, CT (US); Russell P. Sammon, San Francisco, CA (US); Robert C. Tedesco, Fairfield, CT (US); Stephen C. Tulley, Monroe, CT (US); Daniel E. Tedesco, Shelton, CT (US)

(73) Assignee: IGT, Reno, NV (US)

( * ) Notice: Subject to any disclaimer, the term of this patent is extended or adjusted under 35 U.S.C. 154(b) by 1355 days.

(21) Appl. No.: 11/855,523

(22) Filed: Sep. 14, 2007

(65) Prior Publication Data

US 2008/0188292 A1 Aug. 7, 2008

Related U.S. Application Data

(60) Provisional application No. 60/888,180, filed on Feb. 5, 2007.

(51) Int. Cl.
*A63F 9/24* (2006.01)

(52) U.S. Cl. ..... 463/25

(58) Field of Classification Search ..... 463/25
See application file for complete search history.

(56) References Cited

U.S. PATENT DOCUMENTS

| | | | |
|---|---|---|---|
| 3,628,259 | A | 12/1971 | Kahn |
| 4,013,157 | A | 3/1977 | Britz et al. |
| 4,156,976 | A | 6/1979 | Mikun |
| 4,621,814 | A | 11/1986 | Stepan et al. |
| 4,624,459 | A | 11/1986 | Kaufman |
| 4,636,951 | A | 1/1987 | Harlick |
| 4,669,731 | A | 6/1987 | Clarke |
| 4,674,618 | A | 6/1987 | Eglise et al. |
| 4,695,053 | A | 9/1987 | Vazquez, Jr. et al. |
| 4,725,924 | A | 2/1988 | Juan |
| 4,758,689 | A | 7/1988 | Nakao et al. |
| 4,805,907 | A | 2/1989 | Hagiwara |
| 4,827,640 | A | 5/1989 | Jones |
| 4,838,552 | A | 6/1989 | Hagiwara |
| 4,926,996 | A | 5/1990 | Eglise et al. |
| 4,969,549 | A | 11/1990 | Eglise |
| 4,983,820 | A | 1/1991 | Dias |
| 4,991,848 | A | 2/1991 | Greenwood et al. |
| 4,999,742 | A | 3/1991 | Stampfli |
| 5,007,641 | A | 4/1991 | Seidman |
| 5,011,159 | A | 4/1991 | Fortunato et al. |
| 5,019,973 | A | 5/1991 | Wilcox et al. |
| 5,056,141 | A | 10/1991 | Dyke |
| 5,088,737 | A | 2/1992 | Frank et al. |

(Continued)

FOREIGN PATENT DOCUMENTS

| | | |
|---|---|---|
| AU | 771847 | 3/2001 |

(Continued)

*Primary Examiner* — Pierre E Elisca
(74) *Attorney, Agent, or Firm* — Neal, Gerber & Eisenberg LLP

(57) ABSTRACT

A method, and a device and system for performing the method are described, the method comprising: determining a value of at least one chip at a wagering game, the plurality of chips being associated with a credit balance; determining, based at least in part on the value of the at least one chip, whether the credit balance is meets a predetermined condition; and providing a benefit if the credit balance meets the predetermined condition.

39 Claims, 9 Drawing Sheets

U.S. PATENT DOCUMENTS

| | | | |
|---|---|---|---|
| 5,116,055 | A | 5/1992 | Tracy |
| 5,123,649 | A | 6/1992 | Tiberio |
| 5,166,502 | A | 11/1992 | Rendleman et al. |
| 5,167,413 | A | 12/1992 | Fulton |
| 5,224,706 | A | 7/1993 | Bridgeman et al. |
| 5,276,312 | A | 1/1994 | McCarthy |
| 5,294,120 | A | 3/1994 | Schultz |
| 5,294,128 | A | 3/1994 | Marquez |
| 5,321,241 | A | 6/1994 | Craine |
| 5,326,104 | A | 7/1994 | Pease et al. |
| 5,332,076 | A | 7/1994 | Ziegert |
| 5,342,047 | A | 8/1994 | Heidel et al. |
| 5,344,144 | A | 9/1994 | Canon |
| 5,356,140 | A | 10/1994 | Dabrowski et al. |
| 5,373,440 | A | 12/1994 | Cohen et al. |
| 5,375,830 | A | 12/1994 | Takemoto et al. |
| 5,377,973 | A | 1/1995 | Jones et al. |
| 5,397,125 | A | 3/1995 | Adams |
| 5,399,847 | A | 3/1995 | Droz |
| 5,401,023 | A | 3/1995 | Wood |
| 5,406,264 | A | 4/1995 | Plonsky et al. |
| 5,415,404 | A | 5/1995 | Joshi et al. |
| 5,450,938 | A | 9/1995 | Rademacher |
| 5,489,101 | A | 2/1996 | Moody |
| 5,498,859 | A | 3/1996 | Farmont |
| 5,505,449 | A | 4/1996 | Eberhardt et al. |
| 5,511,781 | A | 4/1996 | Wood et al. |
| 5,513,102 | A | 4/1996 | Auriemma |
| 5,531,448 | A | 7/1996 | Moody |
| 5,542,669 | A | 8/1996 | Charron et al. |
| 5,570,885 | A | 11/1996 | Ornstein |
| 5,580,055 | A | 12/1996 | Hagiwara |
| 5,584,486 | A | 12/1996 | Franklin |
| 5,584,764 | A | 12/1996 | Inoue |
| 5,593,161 | A | 1/1997 | Boylan et al. |
| 5,611,535 | A | 3/1997 | Tiberio |
| 5,619,066 | A | 4/1997 | Curry et al. |
| 5,627,356 | A | 5/1997 | Takemoto et al. |
| 5,645,485 | A | 7/1997 | Clapper, Jr. |
| 5,651,548 | A | 7/1997 | French et al. |
| 5,657,993 | A | 8/1997 | Merlino et al. |
| 5,678,001 | A | 10/1997 | Nagel et al. |
| 5,706,925 | A | 1/1998 | Orus et al. |
| 5,707,285 | A | 1/1998 | Place et al. |
| 5,709,603 | A | 1/1998 | Kaye |
| 5,711,715 | A | 1/1998 | Ringo et al. |
| 5,718,431 | A | 2/1998 | Ornstein |
| 5,720,662 | A | 2/1998 | Holmes, Jr. et al. |
| 5,722,891 | A | 3/1998 | Inoue |
| 5,732,950 | A | 3/1998 | Moody |
| 5,735,742 | A | 4/1998 | French |
| 5,764,789 | A | 6/1998 | Pare, Jr. et al. |
| 5,766,074 | A | 6/1998 | Cannon et al. |
| 5,768,143 | A | 6/1998 | Fujimoto |
| 5,769,716 | A | 6/1998 | Saffari et al. |
| 5,770,533 | A | 6/1998 | Franchi |
| 5,772,509 | A | 6/1998 | Weiss |
| 5,775,692 | A | 7/1998 | Watts et al. |
| 5,788,573 | A | 8/1998 | Baerlocher et al. |
| 5,791,987 | A | 8/1998 | Chen et al. |
| 5,806,855 | A | 9/1998 | Cherry |
| 5,807,172 | A | 9/1998 | Piechowiak |
| 5,816,916 | A | 10/1998 | Moody |
| 5,816,918 | A | 10/1998 | Kelly et al. |
| 5,817,172 | A | 10/1998 | Yamada et al. |
| 5,823,873 | A | 10/1998 | Moody |
| 5,823,874 | A | 10/1998 | Adams |
| 5,848,932 | A | 12/1998 | Adams |
| 5,855,515 | A | 1/1999 | Pease et al. |
| 5,868,619 | A | 2/1999 | Wood et al. |
| 5,882,105 | A | 3/1999 | Barlow |
| 5,882,258 | A | 3/1999 | Kelly et al. |
| 5,892,210 | A | 4/1999 | Levasseur |
| 5,902,184 | A | 5/1999 | Bennett |
| 5,902,983 | A | 5/1999 | Crevelt et al. |
| 5,910,048 | A | 6/1999 | Feinberg |
| 5,911,418 | A | 6/1999 | Adams |
| 5,934,672 | A | 8/1999 | Sines et al. |
| 5,947,820 | A | 9/1999 | Morro et al. |
| 5,951,397 | A | 9/1999 | Dickinson |
| 5,954,335 | A | 9/1999 | Moody |
| 5,967,893 | A | 10/1999 | Lawrence et al. |
| 5,967,896 | A | 10/1999 | Jorasch et al. |
| 5,976,016 | A | 11/1999 | Moody et al. |
| 5,980,384 | A | 11/1999 | Barrie |
| 5,984,310 | A | 11/1999 | English |
| 5,984,781 | A | 11/1999 | Sunaga |
| 5,993,316 | A | 11/1999 | Coyle et al. |
| 5,997,401 | A | 12/1999 | Crawford |
| 6,003,651 | A | 12/1999 | Waller et al. |
| 6,004,207 | A | 12/1999 | Wilson, Jr. et al. |
| 6,007,066 | A | 12/1999 | Moody |
| 6,007,424 | A | 12/1999 | Evers et al. |
| 6,012,720 | A | 1/2000 | Webb |
| 6,012,832 | A | 1/2000 | Saunders et al. |
| 6,012,981 | A | 1/2000 | Fujioka et al. |
| 6,012,983 | A | 1/2000 | Walker et al. |
| 6,018,718 | A | 1/2000 | Walker et al. |
| 6,021,949 | A | 2/2000 | Boiron |
| 6,032,955 | A | 3/2000 | Luciano et al. |
| 6,038,552 | A | 3/2000 | Fleischl et al. |
| 6,048,269 | A | 4/2000 | Burns et al. |
| 6,050,895 | A | 4/2000 | Luciano, Jr. et al. |
| 6,056,642 | A | 5/2000 | Bennett |
| 6,062,980 | A | 5/2000 | Luciano |
| 6,062,981 | A | 5/2000 | Luciano, Jr. |
| 6,071,192 | A | 6/2000 | Weiss |
| 6,077,163 | A | 6/2000 | Walker et al. |
| 6,089,977 | A | 7/2000 | Bennett |
| 6,089,978 | A | 7/2000 | Adams |
| 6,089,980 | A | 7/2000 | Gauselmann |
| 6,093,102 | A | 7/2000 | Bennett |
| 6,098,985 | A | 8/2000 | Moody |
| 6,099,408 | A | 8/2000 | Schneier et al. |
| 6,102,400 | A | 8/2000 | Scott et al. |
| 6,102,402 | A | 8/2000 | Scott et al. |
| 6,105,962 | A | 8/2000 | Malavazos et al. |
| 6,109,530 | A | 8/2000 | Larson et al. |
| 6,110,041 | A | 8/2000 | Walker et al. |
| 6,113,098 | A | 9/2000 | Adams |
| 6,120,378 | A | 9/2000 | Moody et al. |
| 6,126,165 | A | 10/2000 | Sakamoto |
| 6,126,541 | A | 10/2000 | Fuchs |
| 6,126,542 | A | 10/2000 | Fier |
| 6,129,632 | A | 10/2000 | Luciano |
| 6,132,311 | A | 10/2000 | Williams |
| 6,135,884 | A | 10/2000 | Hedrick et al. |
| 6,139,431 | A | 10/2000 | Walker et al. |
| 6,142,872 | A | 11/2000 | Walker et al. |
| 6,142,874 | A | 11/2000 | Kodachi et al. |
| 6,148,094 | A | 11/2000 | Kinsella |
| 6,149,521 | A | 11/2000 | Sanduski |
| 6,155,925 | A | 12/2000 | Giobbi et al. |
| 6,158,741 | A | 12/2000 | Koelling |
| 6,159,095 | A | 12/2000 | Frohm et al. |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,168,522 | B1 | 1/2001 | Walker et al. |
| 6,168,523 | B1 | 1/2001 | Piechowiak et al. |
| 6,174,233 | B1 | 1/2001 | Sunaga et al. |
| 6,174,235 | B1 | 1/2001 | Walker et al. |
| 6,179,711 | B1 | 1/2001 | Yoseloff |
| 6,186,894 | B1 | 2/2001 | Mayeroff |
| 6,186,895 | B1 | 2/2001 | Oliver |
| 6,190,255 | B1 | 2/2001 | Thomas et al. |
| 6,193,153 | B1 | 2/2001 | Lambert |
| 6,193,606 | B1 | 2/2001 | Walker et al. |
| 6,196,547 | B1 | 3/2001 | Pascal et al. |
| 6,200,218 | B1 | 3/2001 | Lindsay |
| 6,203,429 | B1 | 3/2001 | Demar et al. |
| 6,210,277 | B1 | 4/2001 | Stefan |
| 6,213,874 | B1 | 4/2001 | Heflin |
| 6,213,877 | B1 | 4/2001 | Walker et al. |
| 6,217,022 | B1 | 4/2001 | Astaneha |
| 6,217,448 | B1 | 4/2001 | Olsen |

6,224,482 B1 5/2001 Bennett
6,224,483 B1 5/2001 Mayeroff
6,224,484 B1 5/2001 Okuda et al.
6,227,969 B1 5/2001 Yoseloff
6,227,971 B1 5/2001 Weiss
6,227,972 B1 5/2001 Walker et al.
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,254,482 B1 7/2001 Walker et al.
6,257,979 B1 7/2001 Walker et al.
6,264,109 B1 7/2001 Chapet et al.
6,267,671 B1 7/2001 Hogan
6,270,409 B1 8/2001 Shuster
6,270,410 B1 8/2001 DeMar et al.
6,290,603 B1 9/2001 Luciano, Jr.
6,296,190 B1 10/2001 Rendleman
6,299,165 B1 10/2001 Nagano
6,302,790 B1 10/2001 Brossard
6,302,791 B1 10/2001 Frohm et al.
6,309,299 B1 10/2001 Weiss
6,312,331 B1 11/2001 Tamaki
6,312,334 B1 11/2001 Yoseloff
6,315,662 B1 11/2001 Jorasch et al.
6,330,162 B2 12/2001 Sakamoto et al.
6,336,862 B1 1/2002 Byrne
6,357,746 B1 3/2002 Sadowski
6,358,147 B1 3/2002 Jaffe et al.
6,368,214 B1 4/2002 Luciano
6,371,852 B1 4/2002 Acres
6,375,569 B1 4/2002 Acres
6,375,570 B1 4/2002 Poole
6,394,902 B1 5/2002 Glavich et al.
6,405,174 B1 6/2002 Walker et al.
6,413,163 B1 7/2002 Yamauchi et al.
6,419,578 B1 7/2002 Moody et al.
6,428,412 B1 8/2002 Anderson et al.
6,435,968 B1 8/2002 Torango
6,439,995 B1 8/2002 Hughs-Baird et al.
6,443,456 B1 9/2002 Gajor
6,450,884 B1 9/2002 Seelig et al.
6,464,583 B1 10/2002 Kidron
6,468,156 B1 10/2002 Hughs-Baird et al.
6,491,584 B2 12/2002 Graham et al.
6,500,067 B1 12/2002 Luciano et al.
6,569,013 B1 5/2003 Taylor
6,577,733 B1 6/2003 Charrin
6,599,193 B2 7/2003 Baerlocher et al.
6,609,969 B1 8/2003 Luciano et al.
6,609,970 B1 8/2003 Luciano, Jr.
6,612,927 B1 9/2003 Slomiany et al.
6,616,535 B1 9/2003 Nishizaki et al.
6,634,942 B2 10/2003 Walker et al.
6,634,945 B2 10/2003 Glavich et al.
6,656,043 B2 12/2003 Seelig et al.
6,675,152 B1 1/2004 Prasad et al.
6,682,073 B2 1/2004 Bryant et al.
6,688,976 B1 2/2004 Walker et al.
6,695,696 B1 2/2004 Kaminkow
6,702,675 B2 3/2004 Poole et al.
6,712,693 B1 3/2004 Hettinger
6,712,695 B2 3/2004 Mothwurf et al.
6,739,970 B2 5/2004 Luciano
6,746,016 B2 6/2004 Perrie et al.
6,758,749 B2 7/2004 Krintzman
6,764,396 B2 7/2004 Seelig et al.
6,786,824 B2 9/2004 Cannon
6,802,778 B1 10/2004 Lemay et al.
6,857,957 B2 2/2005 Marks et al.
6,884,167 B2 4/2005 Walker et al.
6,960,133 B1 11/2005 Marks et al.
7,001,274 B2 2/2006 Baerlocher et al.
7,011,309 B2 3/2006 Soltys et al.
7,014,560 B2 3/2006 Glavich et al.
7,052,395 B2 5/2006 Glavich et al.
7,121,943 B2 10/2006 Webb et al.
7,198,569 B2 4/2007 Wolf et al.
7,291,068 B2 11/2007 Bryant et al.
7,318,774 B2 1/2008 Bryant et al.
7,329,179 B2 2/2008 Baerlocher
7,357,714 B2 4/2008 Tessmer et al.
7,419,429 B2 9/2008 Taylor
2001/0006195 A1 7/2001 Sukeda et al.
2001/0018361 A1 8/2001 Acres
2001/0038178 A1 11/2001 Vancura
2001/0054794 A1 12/2001 Cole et al.
2002/0049631 A1 4/2002 Williams
2002/0077175 A1 6/2002 Jorasch et al.
2002/0082076 A1 6/2002 Roser et al.
2002/0086725 A1 7/2002 Fasbender et al.
2002/0094863 A1 7/2002 Klayh
2002/0095387 A1 7/2002 Sosa et al.
2002/0137559 A1 9/2002 Baerlocher
2002/0147040 A1 10/2002 Walker et al.
2002/0155873 A1 10/2002 Berman et al.
2002/0165023 A1 11/2002 Brosnan et al.
2002/0169021 A1 11/2002 Urie et al.
2002/0179401 A1 12/2002 Knox et al.
2002/0187827 A1 12/2002 Blankstein
2002/0193158 A1 12/2002 Weiss et al.
2003/0013516 A1 1/2003 Walker et al.
2003/0025211 A1 2/2003 Bruce et al.
2003/0027623 A1 2/2003 Rose
2003/0054873 A1 3/2003 Peterson
2003/0060266 A1 3/2003 Baerlocher
2003/0092490 A1 5/2003 Gauselmann
2003/0092786 A1 5/2003 Brassat et al.
2003/0119579 A1 6/2003 Walker et al.
2003/0153383 A1 8/2003 Baerlocher et al.
2003/0195031 A1 10/2003 O'Donovan et al.
2003/0199312 A1 10/2003 Walker et al.
2003/0199313 A1 10/2003 Gonen et al.
2003/0207713 A1 11/2003 Taylor
2003/0216165 A1 11/2003 Singer et al.
2003/0216169 A1 11/2003 Walker et al.
2003/0220138 A1 11/2003 Walker et al.
2004/0017043 A1 1/2004 Moody
2004/0023713 A1 2/2004 Wolf et al.
2004/0038724 A1 2/2004 Asdale
2004/0048650 A1 3/2004 Mierau et al.
2004/0162129 A1 8/2004 Nelson
2004/0204226 A1 10/2004 Foster et al.
2004/0219969 A1 11/2004 Casey et al.
2004/0242313 A1 12/2004 Munoz
2004/0242315 A1 12/2004 Paulsen et al.
2004/0254011 A1 12/2004 Muskin
2005/0009597 A1 1/2005 Daly
2005/0026674 A1 2/2005 Wolf et al.
2005/0029745 A1 2/2005 Walker et al.
2005/0037838 A1 2/2005 Dunaevsky et al.
2005/0054429 A1 3/2005 Baerlocher et al.
2005/0059481 A1 3/2005 Joshi et al.
2005/0059482 A1 3/2005 Hedrick et al.
2005/0060050 A1 3/2005 Baerlocher
2005/0071023 A1 3/2005 Gilliland et al.
2005/0079911 A1 4/2005 Nakatsu
2005/0090306 A1 4/2005 Seelig et al.
2005/0130737 A1 6/2005 Englman et al.
2005/0176494 A1 8/2005 Thomas
2005/0202863 A1 9/2005 Macaulay
2005/0208992 A1 9/2005 Randall
2005/0215311 A1 9/2005 Hornik et al.
2005/0218590 A1 10/2005 O'Halloran et al.
2005/0233803 A1 10/2005 Yang
2005/0282615 A1 12/2005 Englman et al.
2005/0282625 A1 12/2005 Nicely
2005/0282627 A1 12/2005 Hedrick et al.
2005/0282629 A1 12/2005 Gagner
2005/0285337 A1 12/2005 Durham et al.
2006/0003834 A1 1/2006 Okada
2006/0009283 A1 1/2006 Englman et al.
2006/0009286 A1 1/2006 Durham et al.
2006/0014580 A1 1/2006 Hawthorn
2006/0025193 A1 2/2006 Gail et al.
2006/0025211 A1 2/2006 Wilday et al.
2006/0040728 A1 2/2006 Fuller

| | | | | |
|---|---|---|---|---|
| 2006/0058095 | A1 | 3/2006 | Berman et al. | |
| 2006/0063580 | A1 | 3/2006 | Nguyen et al. | |
| 2006/0069619 | A1 | 3/2006 | Walker et al. | |
| 2006/0073873 | A1 | 4/2006 | Rodgers et al. | |
| 2006/0073883 | A1 | 4/2006 | Franks | |
| 2006/0073897 | A1 | 4/2006 | Englman et al. | |
| 2006/0089195 | A1 | 4/2006 | Walker et al. | |
| 2006/0094495 | A1 | 5/2006 | Gelber et al. | |
| 2006/0142077 | A1 | 6/2006 | Miles et al. | |
| 2006/0205480 | A1 | 9/2006 | Glavich et al. | |
| 2006/0252507 | A1 | 11/2006 | Walker et al. | |
| 2006/0252515 | A1 | 11/2006 | Walker et al. | |
| 2006/0287034 | A1 | 12/2006 | Englman et al. | |
| 2007/0021182 | A1 | 1/2007 | Gauselmann | |
| 2007/0060292 | A1 | 3/2007 | Peterson | |
| 2007/0087804 | A1 | 4/2007 | Knowles et al. | |
| 2007/0135207 | A1 | 6/2007 | Tarantino | |
| 2007/0167208 | A1 | 7/2007 | Acres | |
| 2007/0287532 | A1 | 12/2007 | Jackson | |
| 2008/0020848 | A1* | 1/2008 | Muir et al. | 463/42 |
| 2008/0076503 | A1 | 3/2008 | Mattice et al. | |
| 2008/0076529 | A1 | 3/2008 | Richards et al. | |
| 2008/0102934 | A1 | 5/2008 | Tan | |
| 2008/0113702 | A1* | 5/2008 | Schultz et al. | 463/12 |
| 2008/0176642 | A1 | 7/2008 | Phillips et al. | |
| 2009/0124319 | A1 | 5/2009 | Rader et al. | |
| 2010/0099480 | A1* | 4/2010 | Caputo | 463/12 |
| 2010/0113140 | A1* | 5/2010 | Kelly et al. | 463/25 |
| 2010/0227680 | A1* | 9/2010 | Leopold et al. | 463/29 |
| 2011/0039610 | A1* | 2/2011 | Baerlocher et al. | 463/12 |
| 2012/0058814 | A1* | 3/2012 | Lutnick et al. | 463/25 |

FOREIGN PATENT DOCUMENTS

| | | | |
|---|---|---|---|
| AU | 200065501 | | 3/2001 |
| AU | 200245837 | | 12/2002 |
| DE | 3105266 | | 9/1982 |
| EP | 0057602 | | 11/1982 |
| EP | 0360613 | A2 | 3/1990 |
| EP | 0 558 307 | A2 | 2/1993 |
| EP | 753 331 | A2 | 1/1997 |
| EP | 874 337 | A1 | 10/1998 |
| EP | 0 945 837 | | 3/1999 |
| EP | 945 837 | A2 | 9/1999 |
| EP | 0 981 119 | A2 | 2/2000 |
| EP | 0 984 407 | A2 | 3/2000 |
| EP | 989 531 | A2 | 3/2000 |
| EP | 1 076 321 | A1 | 2/2001 |
| EP | 1 195 730 | A2 | 4/2002 |
| EP | 1 589 501 | A1 | 11/2004 |
| EP | 1 536 388 | A1 | 1/2005 |
| EP | 1 513 114 | A2 | 3/2005 |
| EP | 1 580 701 | A2 | 3/2005 |
| GB | 970806 | | 9/1964 |
| GB | 2 137 392 | A | 10/1984 |
| GB | 2292245 | | 2/1996 |
| GB | 2 322 217 | A | 8/1998 |
| GB | 2382911 | | 6/2003 |
| GB | 2 387 950 | A | 10/2003 |
| WO | WO 85/00910 | | 2/1985 |
| WO | WO 98/00207 | | 1/1998 |
| WO | WO 98/35309 | | 8/1998 |
| WO | WO 99/03078 | | 1/1999 |
| WO | WO 99/19027 | | 4/1999 |
| WO | WO 02/078804 | | 10/2002 |
| WO | WO 03/026757 | | 4/2003 |
| WO | WO 2005/010831 | | 3/2005 |
| WO | WO 2005/077480 | | 8/2005 |
| WO | WO 2005/083599 | | 9/2005 |
| WO | WO 2006/002241 | | 1/2006 |
| WO | WO 2006/004831 | | 1/2006 |
| WO | WO 2006/015442 | | 2/2006 |
| WO | WO 2006/017431 | | 2/2006 |
| WO | WO 2007/090270 | | 8/2007 |

* cited by examiner

510

| LOGGED EVENT | AMOUNT CREDITED OR DEBITED | RESULTING CREDIT BALANCE | RESULTING BALANCE IS 120 COINS OR MORE? | BALANCE RISES ABOVE 130 COINS? |
|---|---|---|---|---|
| PLAYER PURCHASES $80 IN CHIPS | + 80 COINS | 80 COINS | NO | NO |
| BONUS FOR INSERTING $20 BILL | + 5 COINS | 85 COINS | NO | NO |
| PLAYER PURCHASES $40 IN CHIPS | + 40 COINS | 125 COINS | YES | NO |
| PLAYER BETS 3 COINS ON GAME, LOSES | - 3 COINS | 122 COINS | YES | NO |
| PLAYER BETS 3 COINS ON GAME, LOSES | - 3 COINS | 119 COINS | NO | NO |
| PLAYER BETS 3 COINS ON GAME | - 3 COINS | 116 COINS | NO | NO |
| PLAYER WINS 1 TO 1 PAYOUT | + 6 COINS | 122 COINS | YES | NO |
| PLAYER BETS 3 COINS ON GAME | - 3 COINS | 119 COINS | NO | NO |
| PLAYER WINS 1 TO 1 PAYOUT | + 6 COINS | 125 COINS | YES | NO |
| PLAYER BETS 6 CREDITS ON GAME, LOSES | - 6 COIN | 119 COINS | NO | NO |
| PLAYER BETS 6 CREDITS ON GAME, LOSES | - 6 COIN | 113 COINS | NO | NO |

FIG. 5A

510

| LOGGED EVENT | AMOUNT CREDITED OR DEBITED | RESULTING CREDIT BALANCE | RESULTING BALANCE IS 120 COINS OR MORE? | BALANCE RISES ABOVE 130 COINS? |
|---|---|---|---|---|
| PLAYER BETS 3 COINS ON GAME, LOSES | - 3 COINS | 110 COINS | NO | NO |
| PLAYER BETS 10 COINS ON GAME | - 6 COINS | 104 COINS | NO | NO |
| PLAYER WINS 3 TO 2 PAYOUT | + 25 COINS | 129 COINS | YES | NO |
| PLAYER BETS 5 COINS ON GAME | - 5 COINS | 124 COINS | YES | NO |
| PLAYER WINS 1 TO 1 PAYOUT | + 10 COINS | 134 COINS | YES | YES |
| BONUS FOR BALANCE RISING ABOVE 130 COINS | + 2 COINS | 136 COINS | YES | NO |
| PLAYER BETS 5 COINS ON GAME, LOSES | - 5 COINS | 131 COINS | YES | NO |
| PLAYER BETS 3 COINS ON GAME, LOSES | - 3 COINS | 128 COINS | YES | NO |
| PLAYER BETS 3 COINS ON GAME | - 3 COINS | 125 COINS | YES | NO |
| PLAYER WINS 1 TO 1 PAYOUT | + 6 COINS | 131 COINS | YES | YES |
| BONUS FOR BALANCE RISING ABOVE 130 COINS | + 2 COINS | 133 COINS | YES | NO |
| PLAYER BETS 3 COINS ON GAME, LOSES | - 3 COINS | 130 COINS | YES | NO |

FIG. 5B

610

| BENEFIT IDENTIFIER | CONDITION FOR PROVIDING BENEFIT | DESCRIPTION OF BENEFIT |
|---|---|---|
| BEN-3818068-01 | (CREDIT_BALANCE >= 120 COINS) | MODIFIED PAYOUT TABLE |
| BEN-3818068-02 | CREDIT BALANCE RISES ABOVE 130 COINS | FREE BET OF 2 CREDITS |
| BEN-3818068-03 | $100 IN CHIPS PURCHASED AT ONE TIME | 2 COINS ADDED TO CREDIT BALANCE |
| BEN-3818068-04 | A FRIEND OF PLAYER MAINTAINS A CREDIT BALANCE OF MORE THAN 100 COINS | PAYOUT FOR BLACKJACK IS 2 TO 1 |
| BEN-3818068-05 | (CREDIT_BALANCE > $40) AND (BILL_INSERTED) | FREE DINNER FOR TWO AT CACTUS CLUB RESTAURANT |

FIG. 6

710

| INDICATION IDENTIFIER | CONDITION FOR PROVIDING INDICATION | INDICATION TO BE PROVIDED |
|---|---|---|
| IND-081234498-01 | CREDIT BALANCE FALLS BELOW 120 COINS | "YOUR BALANCE IS NOW LESS THAN 120 COINS, SO YOU NO LONGER QUALIFY FOR THE MODIFIED PAYOUT TABLE. TO INCREASE YOUR BALANCE AND GET INCREASED PAYOUTS, INSERT MORE MONEY." |
| IND-081234498-02 | CREDIT BALANCE IS LESS THAN 130 COINS | "IF YOU INCREASE YOUR CREDIT BALANCE TO MORE THAN 130 COINS, YOU GET A FREE $5 HAND" |
| IND-081234498-03 | $10 BILL INSERTED INTO BILL ACCEPTOR | "IF YOU INSERT ANOTHER $10, YOU'LL GET 3 MORE COINS AS A BONUS" |
| IND-081234498-04 | CREDIT BALANCE IS GREATER THAN 50 COINS AND A PLAYER WINS A 7-7-7 JACKPOT | "YOU CAN GET A BONUS OF 20 COINS IF YOU MAINTAIN A BALANCE OF MORE THAN 200 COINS FOR 80 GAMES" |
| IND-081234498-05 | (CREDIT_BALANCE > $40) AND (BILL_INSERTED) | "IF YOU INCREASE YOUR BALANCE TO $80, THEN YOU GET FREE INSURANCE FOR 20 HANDS" |
| IND-081234498-06 | A FRIEND OF PLAYER INCREASES A CREDIT BALANCE TO MORE THAN 100 COINS | "YOUR FRIEND JUST INCREASED HIS CREDIT BALANCE TO MORE THAN 100 COINS. IF HE KEEPS IT AT THIS LEVEL, BLACKJACK PAYS 2 TO 1 FOR THE NEXT 20 HANDS" |

FIG. 7

METHOD AND APPARATUS FOR PROVIDING A BONUS TO A PLAYER

This application claims priority to provisional application 60/888,180 filed Feb. 5, 2007 and entitled METHODS AND APPARATUS FOR PROVIDING A BONUS BASED ON CHIPS OF A TABLE GAME, the entirety of which is incorporated by reference herein.

FIELD OF THE INVENTION

The present disclosure relates to a game of chance and more particularly to increasing the monetary balance available for wagering within a game of chance.

BRIEF DESCRIPTION OF THE DRAWINGS

FIGS. 5A and 5B illustrate a sample table from a session log database stored in a data storage device in accordance with one embodiment of the present invention;

FIG. 6 illustrates a sample table from a benefit database stored in a data storage device in accordance with an embodiment of the present invention;

FIG. 7 illustrates a sample indication table from an indication database stored in a data storage device in accordance with an embodiment of the present invention;

DETAILED DESCRIPTION

Figure 1:
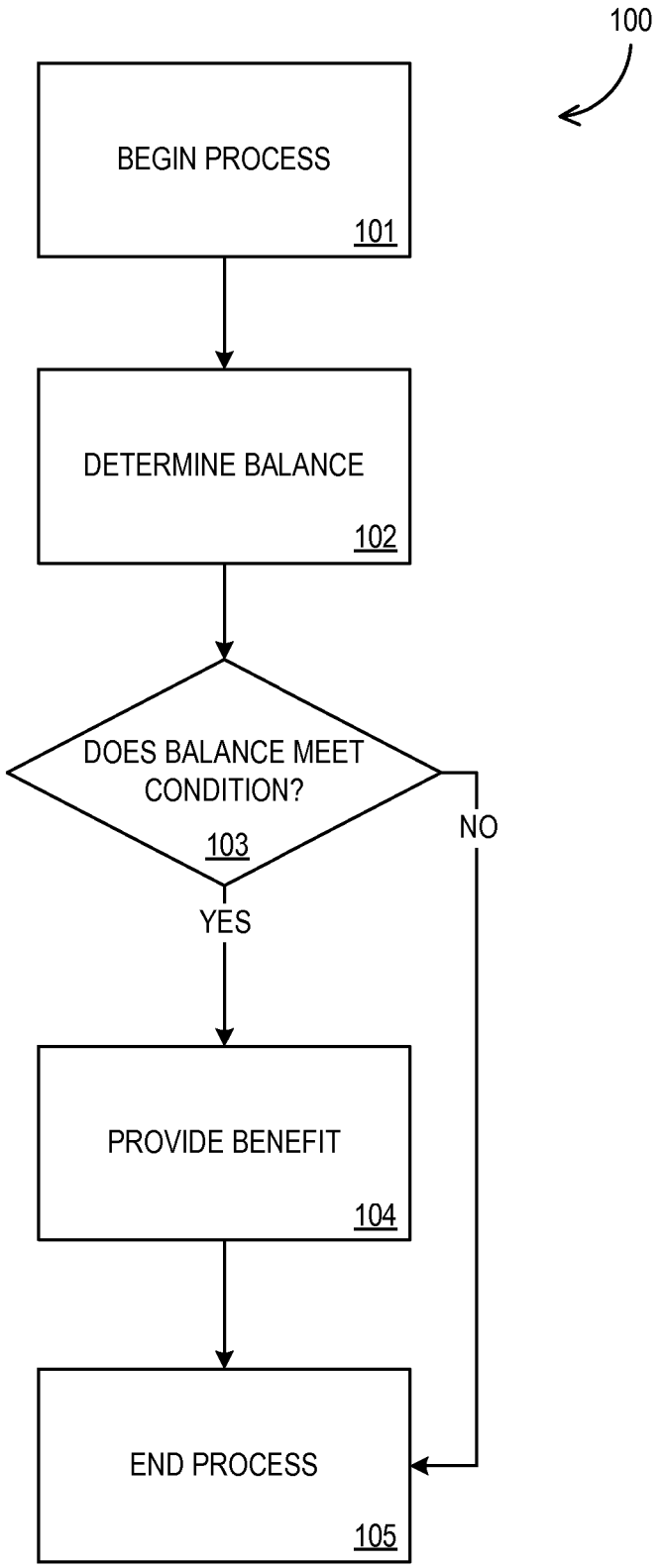
FIG. 1 illustrates a flow chart of an example embodiment of the methodology of the present invention.

Wagering games and games of chance are a major draw for players visiting a casino. Applicants have recognized that it may be beneficial to provide a bonus to a player based on a monetary balance associated with a player (e.g., based on a monetary balance that the player maintains for wagering) or otherwise based on wagering activity of the player.

For example, commonly-owned and co-pending U.S. patent application Ser. No. 10/419,306 filed Apr. 18, 2003 and entitled METHOD AND APPARATUS FOR PROVIDING A BONUS TO A PLAYER BASED ON A CREDIT BALANCE describes an apparatus and method which allows a value of a credit balance on a gaming device to be determined. If the value is not less than a predetermined threshold, a benefit is provided to the player of the gaming device. In various embodiments, the benefit may be, e.g., an increase in the player's credit balance. Aspects of this application having to do with providing a bonus to a player based on a monetary balance associated with the player are incorporated by reference herein.

Commonly-owned and co-pending U.S. application Ser. No. 09/597,801 filed Jun. 20, 2000 and entitled GAMING TOKEN HAVING A VARIABLE VALUE describes using enhanced casino tokens to track and motivate players. For example, a system may be installed in a casino allows gambling chips in the casino to have variable values. Each chip has an electronic circuit installed in it to store a chip identifier and data indicative of a value currently associated with the chip. Slot machines and other devices are arranged to interact with the gambling chips to read and write data from and into the chips. A central controller is connected to the slot machines and other devices that interact with the chips. The chips carry a display and/or an audio device to apprise players of the value currently associated with the chip. Aspects of this application having to do with modifying a value of a chip in order to reward a player are incorporated by reference herein.

As described herein, Applicants have recognized that it would be beneficial to employ additional novel bonusing and other motivational techniques at table games to motivate players to maintain a certain chip balance or to engage in other gambling behavior that is profitable or potentially profitable to a casino or other gambling establishment.

A method, apparatus and system is provided for providing a benefit to a player of a wagering game based on an amount of a player's currency being available for wagering. This amount, which may comprise a player's chip count or credit meter balance, is distinct from the actual wager amount and represents a total amount "in play."

Benefits to the casino can include a greater amount of currency wagered and/or a concomitant increase in revenue. This revenue increase can outweigh the cost to the casino of providing the benefit, resulting in a net profit. Players may be more likely to bet more if they maintain higher chip counts. That is, simply having more "actionable bankroll" (i.e. chips rather than cash) may lead to more wagering activity. Other benefits may include peer pressure, i.e., other players may bet more in response to a first player maintaining a higher chip count and betting more. This is particularly applicable to games like poker in which players compete against each other. In addition, increased revenue may allow casino to provide better bonuses, entertainment, facilities, and other benefits to players. Players may also be more likely to wager for a greater duration of time if adequately motivated to maintain a minimum chip count. Another benefit is that players may be less likely to slow or halt game play in order to re-buy chips if adequately motivated to maintain a minimum (or initial) chip count.

Numerous embodiments have been described, and are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be utilized and that structural, logical, software, electrical and other changes may be made without departing from the scope of the present invention. Accordingly, those skilled in the art will recognize that the present invention may be practiced with various modifications and alterations. Although particular features of the present invention may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

The terms "an embodiment", "embodiment", "embodiments", "the embodiment", "the embodiments", "an embodiment", "some embodiments", "an example embodiment", "at least one embodiment", "one or more embodiments" and "one embodiment" mean "one or more (but not necessarily all) embodiments of the present invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary, a variety of optional components are described to illustrate the wide variety of possible embodiments described herein.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments described herein need not include the device itself.

The term "computer-readable medium" as used herein refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media may include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Transmission Control Protocol, Internet Protocol (TCP/IP), Wi-Fi, Bluetooth, GSM, CDMA, EDGE and EVDO.

Where databases are described, it will be understood by one of ordinary skill in the art that (i) alternative database structures to those described may be readily employed, and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown. Similarly, any illustrated entries of the databases represent example information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes of embodiments described herein. In addition, the databases may, in a known manner, be stored locally or remotely from a device that accesses data in such a database.

It should also be understood that, to the extent that any term recited in the claims is referred to elsewhere in this document in a manner consistent with a single meaning, that is done for the sake of clarity only, and it is not intended that any such term be so restricted, by implication or otherwise, to that single meaning.

In a claim, a limitation of the claim which includes the phrase "means for" or the phrase "step for" means that 35 U.S.C. §112, paragraph 6, applies to that limitation.

In a claim, a limitation of the claim which does not include the phrase "means for" or the phrase "step for" means that 35 U.S.C. §112, paragraph 6 does not apply to that limitation, regardless of whether that limitation recites a function without recitation of structure, material or acts for performing that function. For example, in a claim, the mere use of the phrase "step of" or the phrase "steps of" in referring to one or more steps of the claim or of another claim does not mean that 35 U.S.C. §112, paragraph 6, applies to that step(s).

With respect to a means or a step for performing a specified function in accordance with 35 U.S.C. §112, paragraph 6, the corresponding structure, material or acts described in the specification, and equivalents thereof, may perform additional functions as well as the specified function.

Computers, processors, computing devices and like products are structures that can perform a wide variety of functions. Such products can be operable to perform a specified function by executing one or more programs, such as a program stored in a memory device of that product or in a memory device which that product accesses. Unless expressly specified otherwise, such a program need not be based on any particular algorithm, such as any particular algorithm that might be disclosed in the present application. It is well known to one of ordinary skill in the art that a specified function may be implemented via different algorithms, and any of a number of different algorithms would be a mere design choice for carrying out the specified function.

Therefore, with respect to a means or a step for performing a specified function in accordance with 35 U.S.C. §112, paragraph 6, structure corresponding to a specified function includes any product programmed to perform the specified function. Such structure includes programmed products which perform the function, regardless of whether such product is programmed with (i) a disclosed algorithm for performing the function, (ii) an algorithm that is similar to a disclosed algorithm, or (iii) a different algorithm for performing the function.

The term "gaming device" may be a machine that enables a player to play a wagering game, or a game of chance. Examples of gaming devices include slot machines, video poker terminals, personal computers facilitating a wagering game program, portable computing devices facilitating a wagering game program, video blackjack machines and pachinko machines. Devices or components associated with an electronic or smart table supporting a table game, including the Rapid Table Games™ system from ShuffleMaster™, the DTS-X Table™ from DigiDeal™, Bally Table Management Systems (TMS)™, the Gold Club™ Black Jack table, and the G3™ table system from DEQ Systems™, may also be considered gaming devices (as may be the electronic or smart tables themselves)."

The term "chip" may refer to a gaming chip, (e.g., a round clay chip), token, coin, plaque, or any other item that may be wagered in a wagering game and that may substitute for or be exchanged for money, currency or other consideration. The term "chip" may also refer to virtual chips or currency, e.g., a text or graphical representation of a chip count or credit balance on a gaming device or a display associated with a gaming device. According to some embodiments, a chip may be specialized to enable it to be counted easily (e.g., a gaming chip may have an RFID transmitter embedded inside it). A gaming chip may include, for example: internal memory (e.g., flash memory), unique identifiers (e.g., to avoid chip theft and counterfeiting), machine readable markings (e.g., bar codes) to aid in optical chip counting, and/or LED transmitter (e.g., infrared). The term "chip count" may refer to a balance associated with a plurality of a player's chips. Chip count may refer to the balance of chips available for wagering.

The term "game table" may refer to a table or other location where a player may play a game of chance using gaming chips (e.g., poker table, blackjack table, craps table, roulette table, baccarat table). A game table may have one or more chip trays or reserve areas where players may store or stack their casino chips. Each player may have his own chip area and/or chip tray (e.g., a craps table may have 10 chip trays—one for each potential player at the table). One or more sensors (e.g., short-range radio antennas) may be associated with each chip area and/or chip tray, as described herein.

The term "game table computer" may refer to an embedded or associated computer system associated with a game table. The game table computer (see, e.g., FIGS. 4 and 8) may be part of the game table itself (e.g., embedded in the table), or a separate device (e.g., a PC hidden underneath the game table). The game table computer may store a database that includes information about players' chip counts (e.g., how many chips of each denomination each player has, the total value of each player's chips, the total value of all chips at the table). The game table computer may comprise or communicate with a computer server (e.g., that stores databases relating to players).

The term "sensor" may refer to one or more sensors, interrogators or other devices from which a game table computer may receive signals. These signals may help the game table computer to determine a player's chip count (as described in further detail herein). For example, a game table may include a short range RF transceiver or interrogator located near each chip tray. This transceiver/interrogator may enable communication with RFID gaming chips (i.e., chips having RFID devices attached to or embedded in them) stored in the chip area or tray. In another example, a game table may include one or more cameras that enable optical chip counting of a player's chips. In yet another example, a player's seat at a game table may include a radio antenna that can sense gaming chips in a player's pocket. For example, an antenna or other detection means such as an interrogator may be incorporated into the armrest of a chair. Another example of a sensor is a weight sensor capable of weighing a plurality of chips to help determine a chip count.

The term "display screen" may refer to one or more display screens (e.g., associated with a game table computer, on a portable chip tray, on chips, etc.) that may be used to display information to players and/or casino employees. A display screen may comprise, for example, a CRT display, LCD display, LED or DLP projector. In one example, there may be an LED built into a game table next to each chip tray at a game table. In another example, an LED next to a player's chip tray may light up if the player is eligible for a bonus based on his chip count. In yet another example, an LCD screen may be mounted on top of a game table facing a blackjack dealer. The LCD screen may display messages to the blackjack dealer. In one embodiment, a player may have his own display; alternatively multiple players may share a single display (e.g., one big display shared by all players at a game table). In one embodiment, a display screen may include audio speakers (e.g., speakers built into table, headphones/earpiece worn by player) or audio speakers may be used in lieu of a display screen to output information to a player.

FIG. 1 shows an example method 100 according to an embodiment of the invention. The method comprises: beginning the process 101, determining a credit balance of a player at a wagering game 102, e.g., by determining the value of one or more chips associated with the player; determining whether the balance meets a predetermined condition 103, e.g., being above a specified threshold amount, providing a benefit if the balance meets the predetermined condition 104, and ending the process 105.

Figure 2:
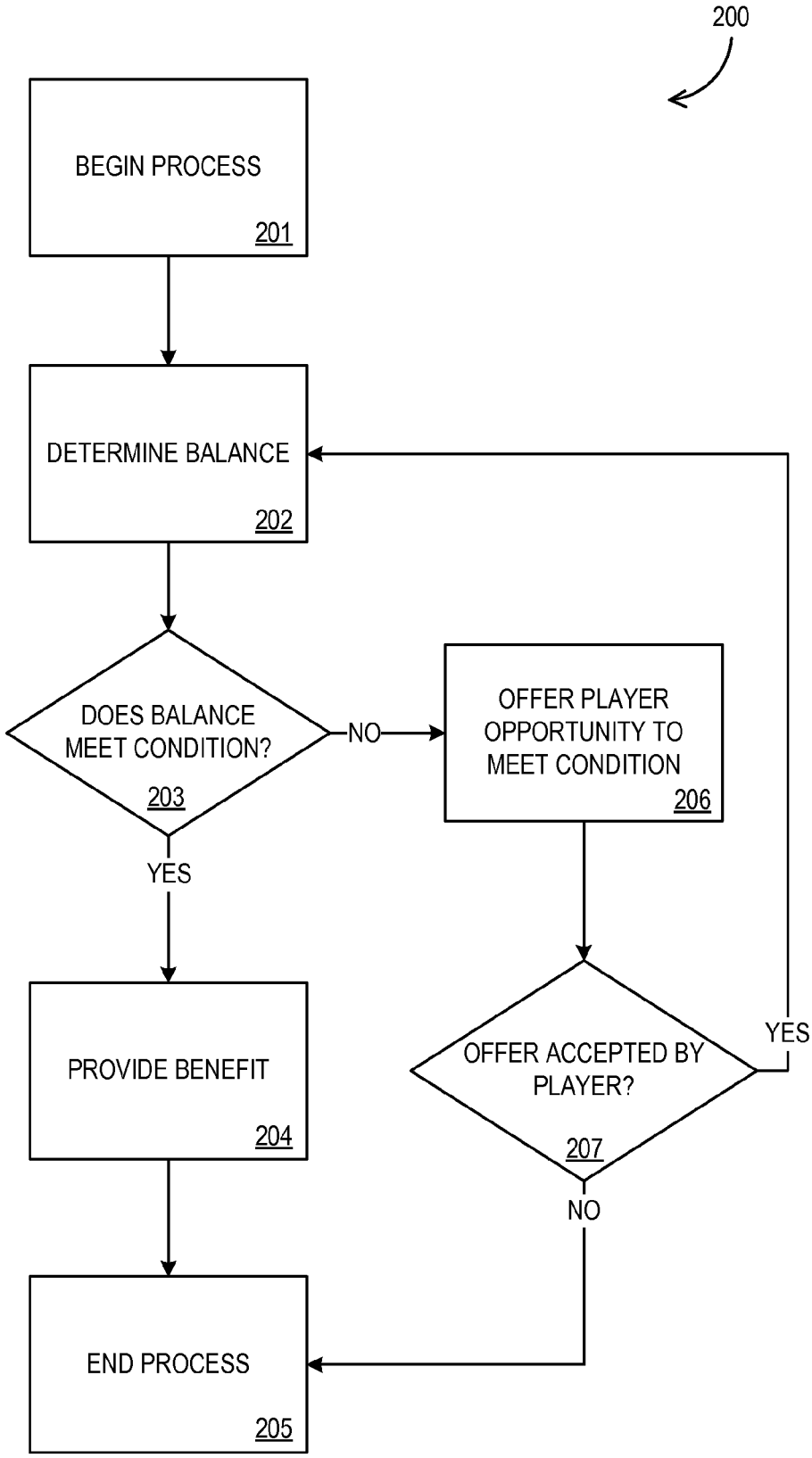
FIG. 2 illustrates a flow chart of an example embodiment of the methodology of the present invention.

FIG. 2 shows another example method 200 comprising steps similar to the method of FIG. 1, including beginning the process 201, determining a credit balance of a player at a wagering game 202, determining whether the balance meets a predetermined condition 203, providing a benefit if the balance meets the predetermined condition 204, and ending the process 205. Additional steps include, if the balance fails to meet the predetermined condition, offering the benefit to the player in exchange for causing his credit balance to meet the condition 206. It is then determined whether the player accepts the offer 207. If the player accepts, the step of determining the credit balance 202 is repeated and the benefit is provided if the credit balance meets the condition. If the player does not accept, the process ends 205.

Figure 3:
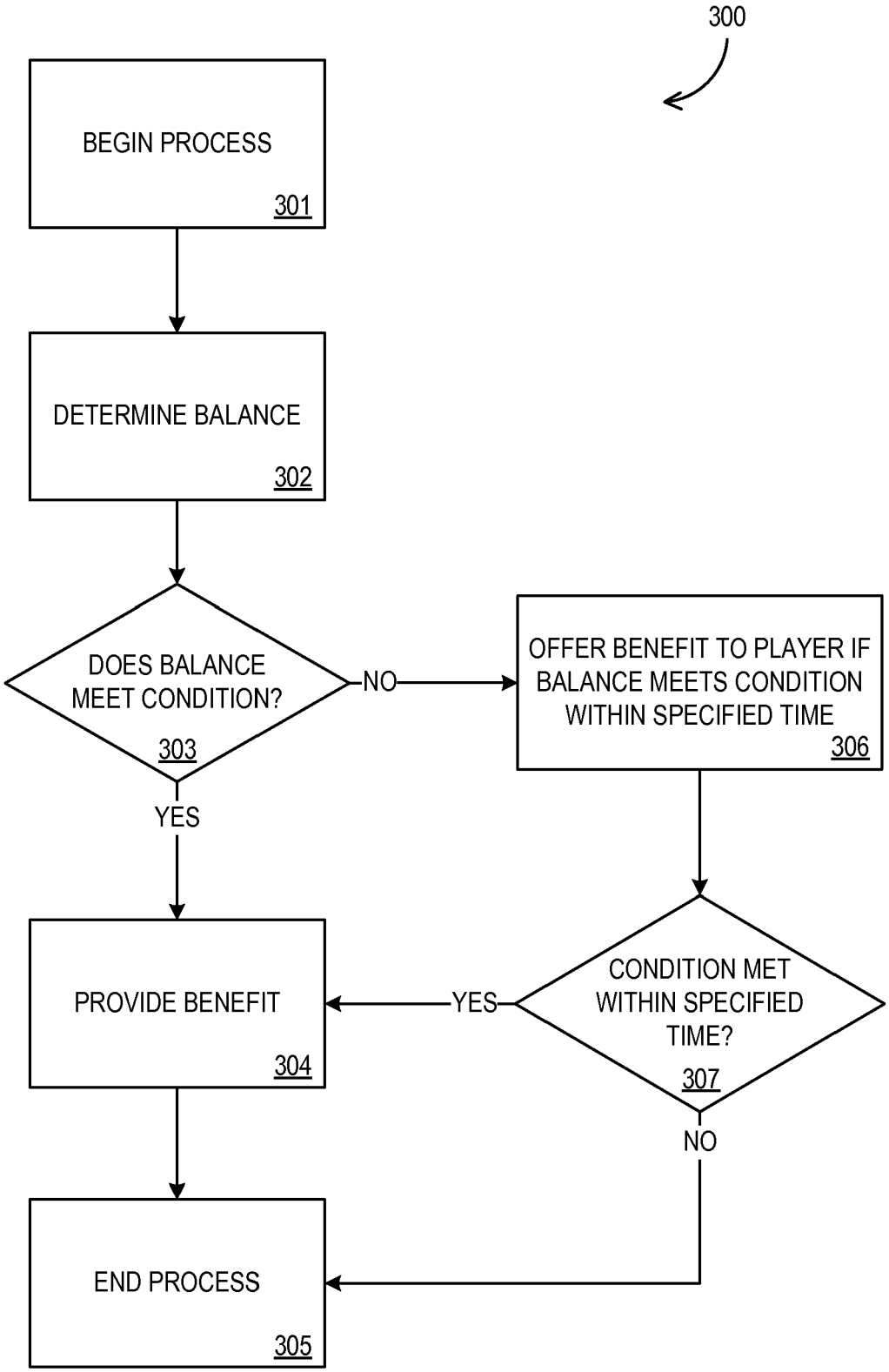
FIG. 3 illustrates a flow chart of an example embodiment of the methodology of the present invention.

FIG. 3 shows another example method 300 comprising steps similar to the method of FIG. 1, including beginning the process 301, determining a credit balance of a player at a wagering game 202, determining whether the balance meets a predetermined condition 303, providing a benefit if the balance meets the predetermined condition 304, and ending the process 305. Additional steps include offering the player the benefit in exchange for causing his credit balance to meet the condition within a predetermined time 306, and determining whether the condition is met within the predetermined time 307. If the condition is met, the benefit is provided 304. If the condition is not met within the predetermined time, the process ends 305.

Determining the player's balance 102 may be accomplished in a number of ways. At a casino table game, a player's balance may be represented by a number of gaming chips representing different currency denominations. Chips may contain indicia to differentiate the different denominations. These indicia can include: text, graphics, patterns, colors, or combinations thereof. These indicia may be machine readable. For example, patterns of shapes and colors, particularly on the edges of chips, may be detected by a camera; based on the image, a computer program may then interpret the patterns and/or colors of the chips and may calculate a chip count. An advantage of machine readable indicia on the chip edges is that, because chips are typically stacked, the edges of all the chips in a stack may still be readily detected.

Determining a balance 102 may be accomplished using other kinds of sensors. The sensors may be part of the gaming table, gaming device, the currency itself, or proximal to one or more of the same. For example, each gaming chip may be embedded with a radio frequency identification ("RFID") chip, which may transmit identifying information when scanned by an RFID transceiver or other scanning device. This identifying information may be received by the RFID transceiver or other device and processed. The RFID transceiver may be part of a gaming table, for example, underneath the table surface. The RFID transceiver may alternatively be part of a portable or handheld device.

Counting chips using radio signals may be preferred in some embodiments and/or by some entities for various reasons. For example, RF transmission may be particularly appropriate for avoiding issues with occlusions which may prevent optical chip counting. Occlusions may be unintentional (e.g., a player resting his hand on his chips and unintentionally preventing a camera from viewing his chips) or intentional (e.g., a player attempting to conceal the amount of chips in play from other players or the dealer). Another added advantage of RFID chips is that players may find it more difficult to alter or counterfeit RFID chips than it would be alter or counterfeit markings on gaming chips. It is also possible that legal tender (e.g., US currency) or other currencies may contain RFID or other machine readable features in the future; some embodiments may be adapted to determine a balance of these currencies.

Determining a balance 102 may also be done visually or manually, for example, by a dealer of a table game. The determining may be exact or can be an estimate. In many embodiments, the criterion may be only whether the balance meets and/or exceeds a particular threshold, or whether the balance falls within a specified range; for these embodiments, an estimate may be sufficient if it is readily apparent that the balance exceeds the threshold by a sizable amount. For example, if the criterion for providing a benefit is only that the balance exceeds $200, a dealer may determine that a player's balance meets the criterion by identifying two or more "black chips" (in many U.S. casinos, chips that are fully or predominantly black are worth $100) in the player's chip count; in this case, an exact count is not necessary to determine whether the balance meets the criterion.

Determining a balance 102 may also be performed via an electronic account, e.g., a credit meter balance. The electronic account may be associated with a player, with a gaming device, or a combination of the two. Embodiments employing an electronic account are described in detail below.

Determining a balance 102 may include determining the balances of other players. These other players may be playing with or against each other. In some embodiments, the total balance of all the players of a table game may be determined. In other embodiments, determining the balance may include determining whether a minimum number of players have a balance meeting a threshold, e.g., whether at least two of five blackjack players at a table have balances above $200. In another example, a bonus may be provided for having the highest balance at a table at any given time, for any given hand, etc. Such an embodiment may involve determining and comparing the balance of each player currently wagering at a table game.

In some embodiments, a computer system (e.g., a computer associated with a game table; a server) may determine a player's chip count. For example, a player's chip count may include chips held by a player in various locations. For example, the chip count may include chips located in a player's chip tray, chips located in front of a player on a game table (e.g., on the felt of a blackjack table) and/or chips located in a player's pocket.

Other examples of technologies that may be used to determine a chip count may include infrared or other methods of wireless transmission, weight sensors, e.g., a game table having one or more weight sensors in a chip tray to determine what chips are in the tray based on weight, or a contact pad by which a value of one or more chips is determined by magnetic or other means. In many of these embodiments, the tray or chip area may indicate where each denomination chips should be stacked or placed in the rack.

Determining a balance 102 may include determining a chip count in embodiments where a player's balance comprises a plurality of physical or virtual chips. A chip count may comprise a number of chips associated with a player, and a determination of the respective value of those chips. Determining a balance may comprise an estimate of the chip count, and can comprise determining a number of one or more different large-denomination chips as an estimate of or a substitute for an exact chip count.

For example, determining the balance 102 may include determining whether the chip count is greater than $200, which may in turn may include determining whether a player's chip count includes at least two $100 chips (typically black). Alternatively, determining the balance may simply include determining whether a player's chip count includes at least 3 chips above a predetermined denomination, e.g. $500. In this example, a qualifying chip count could include two $500 chips (typically purple) and one $1000 chip (typically orange).

Determining a balance 102 may include determining whether the balance reaches, exceeds, or falls short of a threshold (e.g., a predetermined threshold), e.g., meeting a condition 103. The determination may be made at a point in time, or may be made over a period of time. The balance may be represented by an average balance over a given time period, e.g., determining whether a player has maintained an average balance of $200 for the last 60 minutes. The balance may also be compared to predetermined minimum or maximum values, e.g., determining whether a player's balance has dropped below $50 and/or risen above $300 in the last 30 minutes. In other embodiments, the time period may exclude breaks in play, e.g., a player may maintain an average balance of $200 over 10 gaming sessions, or over 3 hours of playing time. These time periods may be further constrained, e.g., the 10 gaming sessions or 3 hours of play must occur in a 3 day period. These embodiments may also be combined, e.g., determining whether the player has maintained an average balance of $200 and also whether the player's balance has remained above $100 for the past 60 minutes.

The threshold may also be dynamic. For example, 90% of the largest chip count at a table may represent the threshold, i.e., a benefit may be provided if a player maintains his chip count at or above 90% of the highest chip count at the table. As chip counts at the table change over time, the player with the highest chip count and the amount of the highest chip count can also change over time.

To maintain a chip count or balance may have several meanings. In some embodiments, it means that the chip count or balance does not fall below the threshold at any time. In other embodiments, a certain number of acceptable "dips" below the threshold may be allowed. For example, a player who doubles down or splits pairs in blackjack and consequently falls below the threshold may still be considered to have maintained his chip count if he purchases enough chips to rise above the threshold within a certain number of hands. In other embodiments, a player may be considered to have maintained his chip count in this situation only if the balance does not fall below a second, lower threshold in the process.

The determination 103 may be made at a predetermined time, or continuously over a predetermined period of time, which may in turn be an indefinite period. Other periods of time at which a determination may be made include a dealer change at a table game, a shuffle or change of a dealer's shoe at a table game. The player may be informed in advance that the determination is about to occur, and a grace period may be granted for the player to cause his balance to meet the threshold if it does not already. For example, if a player loses a large blackjack wager which causes his balance to drop below the threshold, he may be given a limited opportunity to buy more chips in order to bring his balance above the threshold without penalty.

There are many factors that may be considered in determining whether to provide a benefit to a player. Examples of such factors include: (i) the player's total credit balance; (ii) the value of chips held by the player; (iii) the number of chips held by the player; (iv) denominations of one or more chips help by the player; (v) a duration (e.g., 1 hour, 50 games) of play by a player; and (vi) chip counts of one or more other players (see examples below).

These same factors may also be used to determine which of a plurality of benefits to provide. For example, a monetary benefit could be awarded on a sliding scale, with larger amounts being granted for each progressively higher threshold balance level. For example, a bonus of 1% for every $500 of a player's chip count could be awarded ($5 for a balance of $500, $10 for a balance of $1000, etc.).

Once it has been determined that the balance has met a predetermined threshold or condition, a benefit may be provided 104. Some example of the types of benefits that are may be provided include: comp points (e.g., a player may earn comp points at 2× the normal rate so long as he maintains a chip count of at least 100 chips), products or services (e.g., a player may get free drinks so long as he maintains a chip count of at least $100), coupons, or additional gaming chips. Providing comp points may be beneficial since many casinos already have a mechanism for rewarding players with comp points, including: computer systems, marketing techniques, and participating vendors (e.g., restaurants, shops); many players are already familiar with comp points and enthusiastic about receiving comp points; and comp points may have a high perceived value to some players, but can be relatively inexpensive to casinos.

Other examples of benefits include: more favorable odds or payouts. For example, in roulette, a player who maintains a chip count of at least 100 chips may get increased payouts of 36:1 on straight bets as opposed to normal 35:1 payouts, or a player who gets "21" in blackjack may receive a prize payout of 3:1 instead of the traditional 2:1 if the player has at least $100 in chips in his chip tray. Benefits may also include modified game rules, e.g., a player may be allowed to double down more than once in blackjack. See, e.g., U.S. Pat. No. 6,540,230, issued on Apr. 1, 2003 and entitled METHOD AND APPARATUS FOR PLAYING A CARD GAME INCLUDING A BUST INSURANCE OPTION, which is incorporated by reference herein for all purposes and particularly for purposes of providing methods and mechanisms for modifying game rules for a player.

Other possible benefits include enhanced chip values. In some embodiments, the values of some or all of a players chips or other currency may be increased. The enhanced chip value may have a time limit or may only be in effect for a predetermined number of games or rounds. For example, if a player maintains a balance of $1000 for one hour, the value of a player's $25 chips may be increased to $100 for a 15 minute period.

The benefit may be provided manually, e.g., by a dealer or other table game operator, or electronically, e.g., via a player account. In other embodiments, a benefit may be provided to a player by crediting a player account, e.g., via a game table computer and based on a player identifier (described above). For example, providing a benefit may include adding comp points to a player account stored by a computer server. In another example, providing a bonus may include paying off a portion of a player's credit card debt by crediting a bonus to a player's credit card account. In other embodiments, other non-gaming accounts could alternatively or additionally be credited (e.g. a hotel bill, etc.).

In one or more embodiments, a game table computer may prompt a casino employee to provide a benefit to a player. For example, a display screen at a blackjack table may prompt a dealer to give a player a $5 chip as a bonus for maintaining a chip count. In another example, a terminal at a roulette table may prompt a croupier to give a coupon to a player as a bonus for maintaining a chip count. In yet another example, a cocktail waitress may carry a wireless electronic device (e.g., a PDA, a cell phone). A computer server may transmit a signal to this wireless device, causing it to display a message to the cocktail waitress. The message may prompt the cocktail waitress to provide a bonus (e.g., a free ham sandwich, determined based a on a player's preferences) to a player.

In one or more embodiments, a benefit may be provided 104 to a player periodically. For example, a player may receive 1000 comp points every hour so long as he maintains a credit balance of at least $200. In another example, a player may receive a free $1 chip every $10^{th}$ hand in poker so long as he maintains a chip count of at least $150.

In one or more embodiments, a benefit may be provided 104 on a random basis to a player who holds a threshold amount of chips. For example, a player may be encouraged to hold 100 chips at all times if he knows that at any point he may be awarded 5 extra credits provided he's holding 100 chips at that (random) time. In another example, a player may receive a free entry into a game of chance or wagering game, such as a lottery or prize drawing.

In one or more embodiments, a benefit may be provided 104 to a player on an ongoing basis. For example, a player may receive free dealer blackjack insurance so long as he has at least 100 gaming chips in his chip tray at a blackjack table. In another example, a player receives 36:1 payouts on straight bets in roulette so long as he has at least $200 in $10 chips in his chip tray.

In one or more embodiments, a bonus may be provided 104 to a player when an event occurs. For example, a bonus may be provided when a player wins a prize (e.g., winning hand in blackjack). In another example, a bonus may be provided when a player purchases additional gaming chips. In yet another example, a bonus may be provided when a player ends his gaming session and cashes out (converts gaming chips to money).

According to another embodiment, an indication of a benefit may be presented to the player. This indication may be presented before the commencement of or during play, or may be presented at the same time as or following the determining step. See, e.g., FIGS. 1-3. The indication may comprise an offer to the player setting out the conditions under which the player may receive the benefit. The indication may communicated through a dealer or other game operator, may comprise a printed substrate such as advertising, marketing or promotional materials, e.g. a promotional pamphlet or an instructional sign at a blackjack table. The indication may comprise a time limit or other limitation on the offer. The indication may also comprise an electronic prompt, e.g., a promotional window, e.g., 206, 306, at a gaming device operable to facilitate a wagering game, such as a slot machine.

Examples of information that could be provided to the player as an indication of a benefit include: an indication of one or more conditions that a player must meet to receive a benefit (e.g., a player may need to maintain a chip count of at least 100 chips for at least 1 hour), an indication that a player has met a qualification condition for a benefit (e.g., an indication that a player has at least 100 chips) Note that in some embodiments the player may need to maintain this condition for a duration of time (e.g., 1 hour) in order to actually obtain the benefit, an indication that a benefit has been/will be provided to a player (e.g., an LED in a player's chip tray may flash to indicate that the player is receiving a benefit of 1000 comp points based on his chip count), an indication of a benefit that has been/may be provided (e.g., 1000 comp points vs. 2000 comp points), an indication of a player's chip count (e.g., 132 chips, 84 five-dollar chips, $431 in chips), and/or an indication of a suggested action for a player to perform in order to qualify for a benefit. Another example includes an indication of time or games remaining until a benefit is provided, e.g., "Keep your balance above $100 for 6 minutes and earn 1000 free comp points!"

In another example, an LCD display near a player's chip tray may display a message (e.g., "You have $82 in chips. Buy another $20 in chips to qualify for a bonus based on your chip count."). In another example, a customer-facing screen at a cashier's booth may output an "upsell" offer in response to a customer's request to purchase chips. For example, after a customer requests $5 in chips and tenders a $10 bill, an offer may read "buy an extra $5 in chips and get a bonus $1 chip".

Benefits of outputting an indication of a bonus to a player may include, for example, enhancing player awareness of a benefit. Without outputting an indication, a player may not be aware that he has received a benefit, or that he qualifies for a bonus. If a player does not know that he received or is able to receive a benefit based on his balance, he may be less likely to maintain a sufficient balance in the future. Another benefit of outputting an indication of a benefit may include enhancing the motivation of other players to attempt to obtain benefits of their own. Yet another benefit of outputting an indication of a benefit may include enhancing a player's enjoyment of a game via the recognition he receives from casino employees and other players for being a "high roller".

In some embodiments, the indication of a benefit 206 may be output using an electronic device. One example of such an electronic device includes a handheld device operated by player (e.g., cell phone, PDA, pager). For example, in one embodiment a casino may provide a "chip meter" to player that shows how many chips the player has in his chip tray and what bonus the player is entitled to based on the chip count. Another example of such an electronic device includes a personal display screen at game table (e.g., LCD next to player's chip placement area, LED bulb embedded in the game table felt in front of a player). Another example may be a chip that displays the value of all of the chips in the stack below it and/or the bonus. Yet another example of such an electronic device includes a public display screen (e.g., JumboTron™). Outputting an indication of a bonus on a public display may be particularly effective in making players feel special and motivating other players to also maintain high chip counts. Yet another example of such an electronic device includes a display screen viewable by a casino employee (e.g., a blackjack dealer). For example, an LCD display on a game table may prompt a dealer to alert a player, "You currently have 21 five-dollar chips and 10 ten-dollar chips. If you convert your ten-dollar chips to five dollar chips, you'll have more than 30 five-dollar chips and will qualify for a bonus based on your chip count." In yet another example of such an electronic device, one or more gaming chips having LED or other displays may be employed to output an indication of a bonus (e.g., see U.S. Patent Application Ser. No. 60/826,977 (incorporated by reference herein for all purposes) for examples of how an LED gaming chip may be used to output information).

Many of the above examples may be adapted to contain specific features for different specific games. For example, many of the above embodiments are described with respect to traditional casino table games, including blackjack, craps, roulette and baccarat, in which multiple players play against the casino (the "house"). Since the house typically has an edge in these games, it is therefore in the casino's financial interest to have a player keep as much money in play as possible.

One or more embodiments, particularly embodiments which determine the balance of a plurality of players, may include an additional step of determining a player identifier. A player identifier may comprise, for example, player number (e.g., from player tracking card), player name, hotel room number, financial account number (e.g., back account, credit card account). A player identifier may, for example, be entered into game table computer using an input device (e.g., keypad, touch screen, bar code reader, magnetic stripe reader). In one or more embodiments a player may provide his player tracking card when he starts gaming a game table and dealer may swipe the player tracking card through a computer terminal associated with the game table. In one or more embodiments, a player or casino employee may use a keypad to enter a player's hotel room number into a game table computer. This is helpful in embodiments which track players over time and/or across multiple gaming sessions.

Other casino games can also benefit from larger player chip counts. For example, poker is typically played with several players competing against each other. In many casino poker rooms, instead of competing directly with the players, the house instead takes a small percentage (a "rake") of each pot. When more than one player has a large chip count or "stack," the chances of those players raising each other and generating a large pot increases. As the pot increases, so does the rake; therefore, it is in the casino's interest to encourage multiple players at a poker table to maintain large chip counts.

Other embodiments may include identifying the player before, during or after the determination of the balance. In some embodiments, the identification may trigger the determination, e.g., if an identification is made of a player having a historically high rate of play, this identification may trigger a determination of his present balance or rate of play. In some embodiments, the threshold or condition will be based at least in part on the identification, e.g., a player with a historically high rate of play may need to maintain a balance at or above his historic average to receive a bonus. In some embodiments, the amount and/or type of benefit may be based at least in part on the identification, e.g., the benefit may be selected based on preferences associated with the player.

Figure 4:
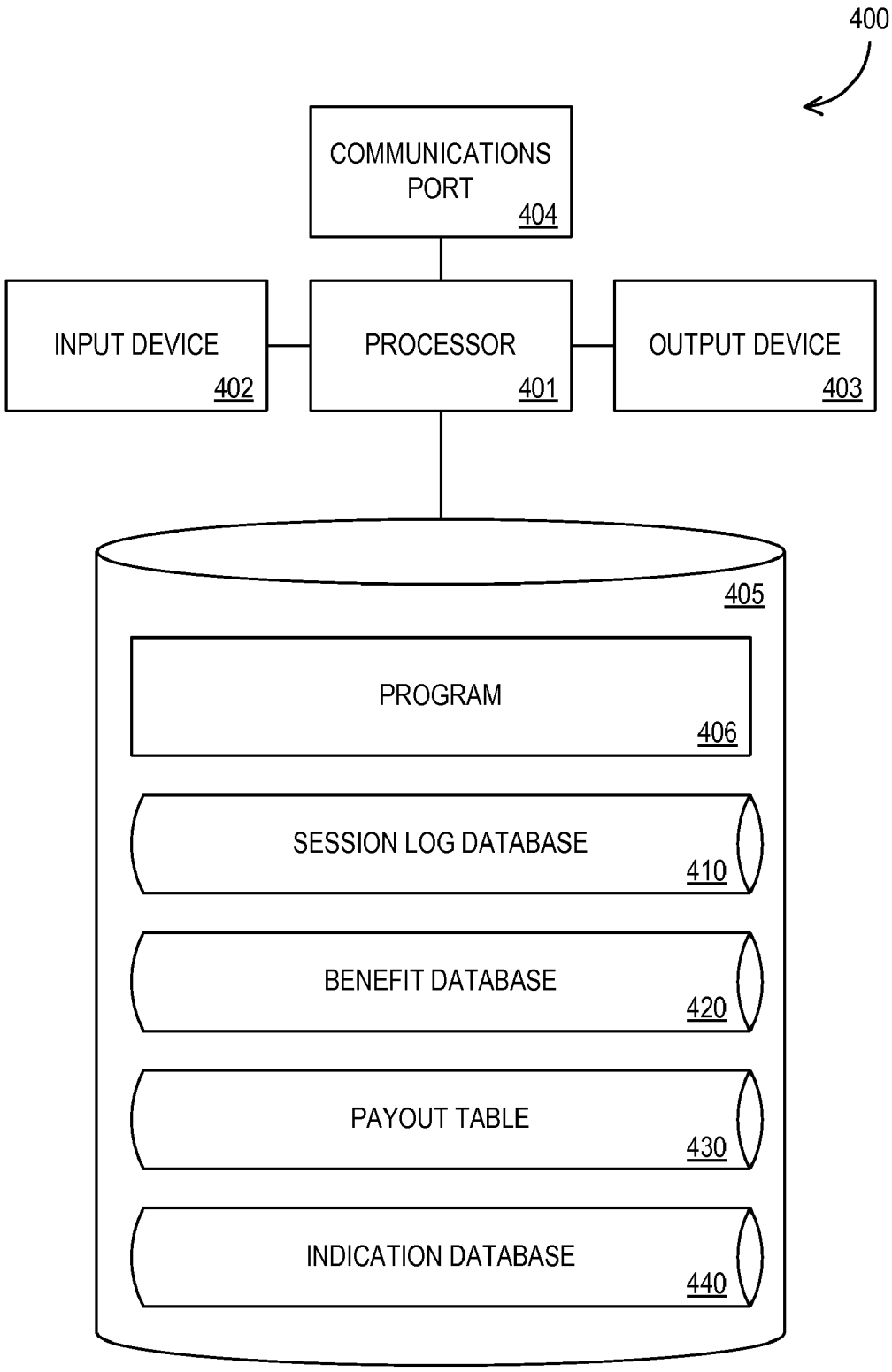
FIG. 4 illustrates a block diagram of a device adapted for use in a gaming establishment that facilitates use of some of the embodiments of the present invention.

FIG. 4 shows a block diagram of a system 400 in accordance with example embodiments. The system comprises a processor 401 connected to one or more input devices 402, output devices 403 and communications ports 404. The processor is also in connected to a computer readable medium 405 containing a program 406 configured to execute one or more method steps of embodiments described above. The computer readable medium also may contain a session log database 410, a benefit database 420, a payout table 430, and/or an indication database 440. These databases may be capable of being accessed by the program 406.

Examples of a processor 401 include a computer CPU. The communications port 404 may comprise an Ethernet or other network connection, and may allow the processor 401 to be in communication with a server (not shown). Examples of input devices 402 include a keyboard, mouse, button array, RFID transceiver, camera, weight sensor, etc. Examples of output devices 403 include a display, LED array, audio speaker, etc.

The session log database 410 may contain information relating to the balances of one or more players over time, and may be used to determine whether the balance meets one or more conditions. The benefit database may 420 contain information relating to various benefits and may include cross references to information in the session log or other databases for determining what benefit to provide, if any. The payout table 430 may include information relating to standard and modified payouts, and may contain cross references with the benefit or other databases. For example, the payout table 430 may contain a cross reference to the benefit table which regulates whether a standard or modified payout table applies to a given player based on a reference to the session log database entries for that player. The indication database 440 may contain information relating to which indications have been presented to which players, and whether those players have responded favorably to those indications.

FIGS. 5A-5B show an example session log database 510, e.g., for use as session log database 410 in system 400 (FIG. 4). Session log database 510 provides a repository of events that took place at a wagering game during individual playing session. Session log database 510 maintains a plurality of records, each associated with a different game session. For each session by a logged event 507, session log database 510 includes: (1) amount credited or debited field 515; (2) resulting credit balance field 520; (3) whether the resulting balance is 120 credits or more field 425; and (4) whether the balance rises above 130 credits field 530. The above are examples of conditions that may be present and which would allow a player to receive a benefit. For example, with respect to field 525 (whether the resulting balance is 120 credits or more), a player may receive a benefit if his credit balance is greater than or equal to 120 credits. The data stored in session log database 510 is used with the methods contemplated by embodiments of this invention and described below. In this embodiment, the term "credit" may refer to chips totaling a specific dollar amount. For example, 3 credits may be represented by one or more chips totaling $3.

According to one embodiment, information about a credit balance or changes in a credit balance such as field 515 (amount credited or debited) and field 520 (resulting credit balance) may be stored in session log database 510. As illustrated in record 545 and record 546, a player purchased $80 in chips at a wagering game (blackjack in this example) and then received a bonus of 5 credits ($5) for purchasing $80 worth of chips.

Each time a debit or credit is made to a credit balance, this change may be recorded in session log database 510. Field 520 (resulting credit balance) keeps track of the credit balance that results from each event. This value may be added to field 520 (resulting credit balance) from the previous record to determine the resulting credit balance field 520.

Session log database 510 may also store indications of whether conditions are true. These conditions may be based on, but are not limited to, the following: 1) a current credit balance at the wagering game; 2) decreases in a credit balance; 3) increases in a credit balance; 4) historical values of a credit balance and 5) various average balances. For example, fields 525, 530, and 540 indicate whether a particular condition is true or false for any particular logged event.

FIG. 6 shows an example benefit database 620, e.g., for use as benefit database 420 in system 400 (FIG. 4). Benefit database 620, provides a table of information concerning benefits that may be provided to a player based upon certain conditions. The data stored in benefit database 620 may be useful in determining a benefit based on a condition relating to a credit balance at a wagering game. Benefit database 620 may be used to track conditions that may be present during a game session and determine what benefit to provide if a condition is true. FIG. 5 shows a possible organization of benefit database 620. Benefit database 620 maintains a plurality of records, each associated with a benefit. For each benefit identified by benefit identifier 625, benefit database 620 includes: the condition for providing a benefit 628, and the description of the benefit 630. The benefit identifier 625 is a unique assigned key that can be used to refer to the particular benefit throughout the system. The "Condition for providing benefit" column 628 lists the particular condition under which a particular benefit will be provided. A variety of different types of conditions are possible, based on but not limited to the following: 1) a current credit balance on a game machine; 2) decreases in a credit balance; 3) increases in a credit balance; 4) historical values of a credit balance; and 5) various average balances. A benefit may be selected to be output to a player if the condition corresponding to that benefit is true.

FIG. 7 shows an example indication database 740, e.g., for use as benefit database 440 in system 400 (FIG. 4). Indication Database 740 stores information which may be useful in determining an indication to output to a player based on a condition relating to a credit balance at a wagering game. FIG. 7 shows a possible organization of indication database 740. Indication database 740 maintains a plurality of records, each associated with a different indication. For each indication identified by an indication identifier in field 710, indication database 740 includes: a condition for providing the indication 720 and the indication to be provided 730. The data stored in indication database 740 may be useful in determining an indication to provide a player based on a condition relating to the credit balance at the wagering game. Indication Identifier 710 may be a unique assigned key that can be used to refer to the particular indication throughout the system.

"Condition for providing indication" column 720 lists the particular condition under which a particular indication will be provided. Conditions may be based on a variety of different factors including but not limited to: 1) a current credit balance on a game machine; 2) decreases in a credit balance; 3) increases in a credit balance; 4) historical values of a credit balance; and 5) various average balances. Furthermore, conditions may be stored in a variety of different forms which will be further discussed below. An indication may be selected to be output if a condition is true. For example, as shown in FIG. 7, if a players credit balance falls below 120 credits, the player will be provided with an indication that "your balance is now less than 120 credits, so you no longer qualify for the modified payout table. To increase your balance and get increased payouts, insert more money."

Figure 8:
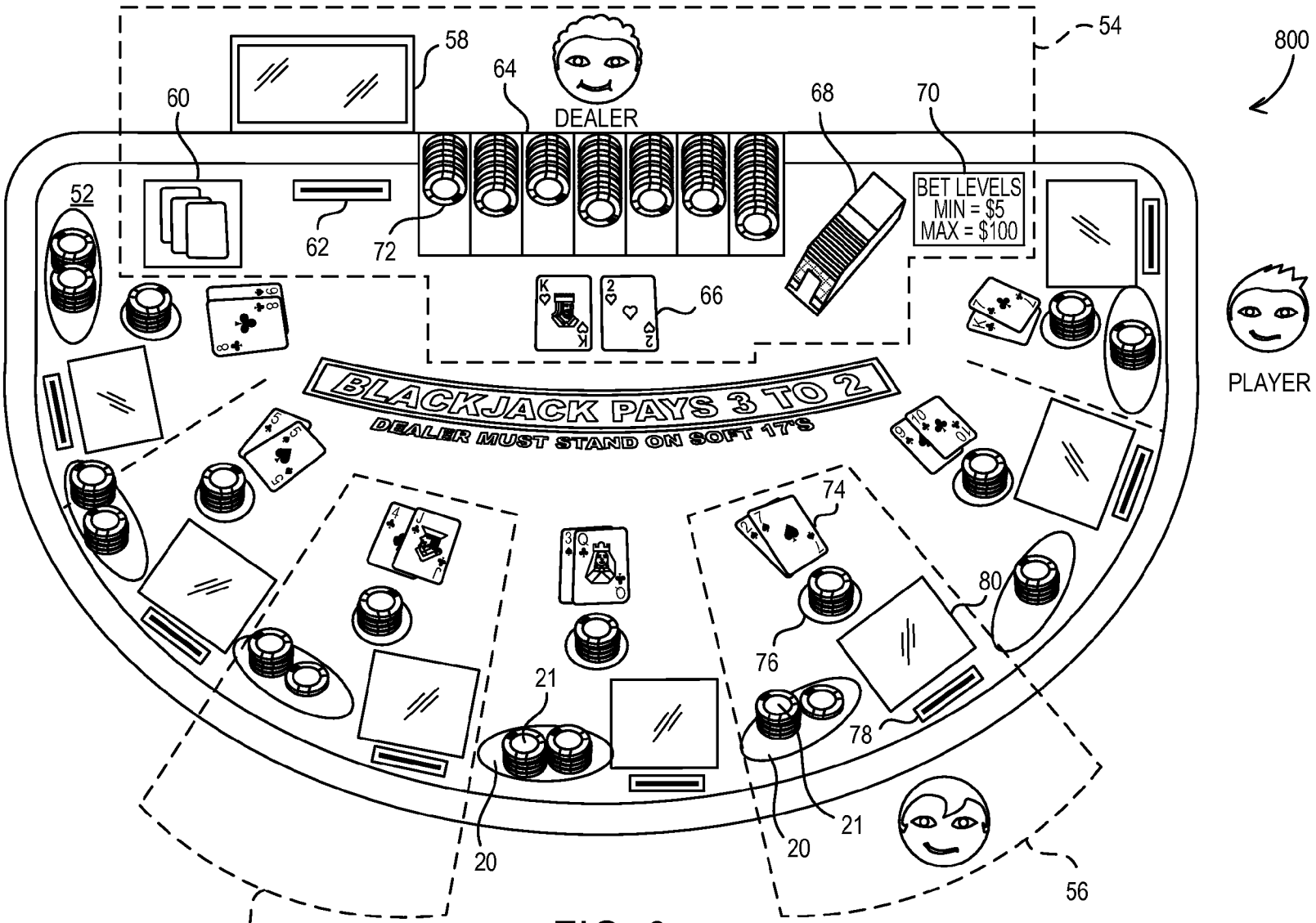
FIG. 8 illustrates a gaming table for use in a gaming establishment that facilitates use of some of the embodiments of the present invention.

FIG. 8 shows a table 50 having a planar top surface 52 on which game play takes place. The table 50 further has a dealer station 54 and at least one player station 56 (seven shown). The dealer station 54 has space for the dealer to stand or sit and may include a dealer monitor or display 58, a discard collection area 60, a cash slot 62, a chip rack 64, a dealer hand area 66, a shoe 68, and a placard 70. It is particularly contemplated that the dealer monitor 58 has touch screen functionality. Alternatively a keyboard or other input mechanism may be provided (not shown).

Chips 72 may be positioned in the chip rack 64 and used throughout the table 50. The chips may include a radio frequency identification (RFID) tag or memory with an electronic circuit or processor and an antenna. The chip 72 may be similar or identical to those disclosed in U.S. Pat. Nos. 5,166,502; 5,676,376; 6,021,949; and 6,296,190, which are all incorporated by reference with respect to these features. Gaming Partners International (GPI), of 1182 Industrial Road, Las Vegas, Nev. 89102 and Shuffle Master, Inc. of 1106 Palms Airport Drive, Las Vegas Nev. 89119 both sell RFID chips suitable for use with the table 50, although neither product is specifically required to practice the concepts of the present disclosure. The GPI chip uses a standard microchip made by Philips Semiconductors called the Vegas S, each of which has a unique serial number. The gaming establishment (e.g., casino) or other entity may associate values with each serial number. The association may be in a look-up table or the like. Alternatively, the unique identifier may be encoded to include information therein. Likewise, the chips 72 may be color-coded or include other indicia, such as indicia (described above) that indicate values to the player or dealer.

In use, the electronic circuit and antenna act as a transponder capable of responding to an interrogator (not shown). In essence, the interrogator sends out an electromagnetic signal that impinges upon the antenna, exciting a current within electronic circuit. In response to the excited current, the electronic circuit causes the antenna to emit a second electromagnetic signal as a response, which is received by the interrogator. The second signal has identifying information about the chip 72 encoded therein such that the interrogator can identify the chip on receipt of the second signal. The second signal may be generated passively or actively. That is, in a first embodiment, the energy from the interrogation signal provides sufficient power for the electronic circuit to use to send the second signal. In a second embodiment, the electronic circuit may include a battery or other power source, which is used to power the generation of the second signal. While batteries have increasingly small footprints and longer lives, it is generally more practical to have a passive transponder.

The chip rack 64 may be one such interrogator. An exemplary chip rack of this sort is made by GPI under the trade name CHIP BANK READER. Alternatively, the interrogators described in U.S. Pat. Nos. 4,814,589; 5,283,422; 5,367,148; 5,651,548; and 5,735,742—all of which are incorporated herein by reference with respect to these features—could be used. Another RFID tag and interrogator suitable for use with at least some embodiments of the present disclosure are produced by Texas Instruments as the TAG-IT™ product line. An improved interrogator is discussed in U.S. Patent Application Publication 2006/0077036, which is also incorporated by reference in its entirety.

The shoe 68 may be an intelligent shoe such as the IS-T1™ and IS-B1™ or the MD1, MD2 sold by Shuffle Master or comparable devices. The shoe 68 may be able to determine which cards are being dealt to which player position through RFID technology, image recognition, a printed code on the card (such as a barcode), or the like. The particular technique used to recognize cards is not central to the present disclosure. Further information about intelligent shoes may be found in U.S. Pat. Nos. 5,941,769 and 7,029,009, both of which are incorporated by reference with respect to these features, and U.S. Patent Application Publications 2005/0026681; 2001/7862227; 2005/0051955; 2005/0113166; 2005/0219200; 2004/0207156; and 2005/0062226 all of which are incorporated by reference with respect to these features. In place of an intelligent shoe, cameras may be used with pattern recognition software to detect what cards have been dealt to what player positions. One method for reading data from playing cards at table games is taught by German Patent Application No. P44 39 502.7. Other methods are taught by U.S. Patent Application Publication 2007/0052167 both of which are incorporated by reference with respect to these features. Similarly, cameras may be used to detect when a lammer was given or removed from a specific player. This information may be helpful should the gaming establishment need to audit a session.

The player station 56 may include a player hand area 74, a betting circle 76, a player tracking mechanism 78, and a player display 80. The player hand area 74 is the area into which the dealer deals the cards for the player. Note that if the shoe 68 cannot or does not track the cards, it is possible to use RFID technology or other image recognition technology to determine what cards have been dealt to the player once the cards have been placed in the player hand area 74. The interested reader is referred to the previously incorporated application 2004/0207156. The betting circle 76 may further be associated with an interrogator so that chips 72 placed in the betting circle may be detected. Another technique would be to put a card reader in the discard collection area 22. In this embodiment, each player station 56 also has a chip pad 20 on which the player's chips 21 may be kept. In this example, the chips 21 on the chip pad 20 are not presently being wagered, but are nevertheless considered "in play" for balance determination purposes.

The player tracking mechanism 78 may be a card reader adapted to receive a magnetic stripe card such as is commonly used in gaming establishments. Alternatively, the player tracking mechanism 78 may be a smart card reader, an RFID interrogator that interrogates a player tracking RFID fob, or other device as desired.

The display 80 may be a display as that term is defined in the Rules of Interpretation set forth below. The display 80 may be a touch screen display and/or have associated input elements such as a keypad or keyboard. Collectively, the display 80 and any associated input elements are termed a player interface. Information about the player, about the session in which the player is participating, or other information may be presented on the display 80 as described herein. In a first embodiment, each player station 56 has its own display 80. In an alternate embodiment, all the player stations 56 at the table 50 share a single display 80 (not shown). Appropriate indicia may be used to distinguish which information relates to which player. In this embodiment, the display 80 may be positioned so that it is readily seen by each player. For example, the display may be vertically mounted proximate the placard 70. The display 80 may be a touch screen display or include a keyboard, keypad or other user input as desired. In still another embodiment, one or more player stations 56 share one or more displays 80 (not shown). While not shown, the player station 56 may also include a bill acceptor and/or a cashless gaming receipt device such as the TITO bill validating device such as a FutureLogic GEN2™ PSA-66 device configured to operate within an EZ-PAY™ system by IGT. Another variation is to use a mobile terminal as a display.

Chip pad 20 may include an RFID interrogator, weight sensor, or other sensing device, described above. Chips 21 may also be detected and measured by other methods described above, such as via a camera (not shown) configured to perform optical chip counting methods.

While the table 50 is particularly contemplated, it may be possible to modify an existing table to include the functionality of some or all of the embodiments of the present disclosure. For example, PGI, with Shuffle Master and IGT, sells an intelligent table under the moniker INTELLIGENT TABLE SYSTEM™ together with software entitled TABLE MANAGER™. Other intelligent table systems sold by Progressive include the TABLELINK PLAYER TRACKING, TABLELINK CHIP TRACKING, TABLELINK GAME TRACKING, TABLELINK TOTALVIEW, and TABLELINK CUBE. Further intelligent table teachings can be found in U.S. Pat. Nos. 6,676,517 and 7,011,309 as well as U.S. Patent Application Publications 2002/0147042; 2003/0003997; 2005/0026680; 2005/0051965; and 2005/0054408, all of which are incorporated by reference with respect to the above features.

While the method and apparatus of the present invention has been described in terms of its presently preferred and alternate embodiments, those skilled in the art will recognize that the present invention may be practiced with modification and alteration within the spirit and scope of the appended claims. The specifications and drawings are, accordingly, to be regarded in an illustrative rather than a restrictive sense.

Further, even though only certain embodiments have been described in detail, those having ordinary skill in the art will certainly appreciate and understand that many modifications, changes, and enhancements are possible without departing from the teachings thereof.

What is claimed is:

1. A method comprising:

causing at least one processor to execute a plurality of instructions stored in at least one memory device to operate with a sensor to collect identifying information of at least one physical chip available for wagering on a wagering game played at a gaming table, the at least one physical chip being associated with a credit balance;

causing the at least one processor to execute the plurality of instructions to determine a value of the at least one physical chip based on the collected identifying information;

causing the at least one processor to execute the plurality of instructions to determine, based at least in part on the value of the at least one physical chip, whether the credit balance meets a predetermined condition; and causing a benefit to be provided if the credit balance meets the predetermined condition.

2. The method of claim 1 wherein the benefit comprises:

a form of consideration that motivates a player of the wagering game to cause the credit balance to meet the predetermined condition.

3. The method of claim 1, wherein causing the benefit to be provided if the credit balance meets the predetermined condition comprises:

causing the at least one processor to execute the plurality of instructions to determine the benefit to be provided to a player of the wagering game.

4. The method of claim 3, wherein causing the at least one processor to execute the plurality of instructions to determine the benefit to be provided to the player of the wagering game comprises:

causing the at least one processor to execute the plurality of instructions to select a pre-determined benefit associated with a value of the credit balance; and causing the selected pre-determined benefit associated with the value of the credit balance to be provided.

5. The method of claim 1, wherein:

causing the at least one processor to execute the plurality of instructions to operate with the sensor to collect the identifying information of the at least one physical chip comprises causing the at least one processor to execute the plurality of instructions to operate with the sensor to collect the identifying information of every physical chip: (a) available for wagering on the wagering game, and (b) associated with a player of the wagering game; and causing the at least one processor to execute the plurality of instructions to determine the value of the at least one physical chip based on the collected identifying information comprises causing the at least one processor to execute the plurality of instructions to determine, based on the collected identifying information, the value of every physical chip: (a) available for wagering on the wagering game, and (b) associated with the player of the wagering game.

6. The method of claim 1, wherein causing the at least one processor to execute the plurality of instructions to operate with the sensor to collect the identifying information of the at least one physical chip includes causing the at least one processor to execute the plurality of instructions to cause the sensor to collect the identifying information of the at least one physical chip via at least one RFID device associated with the at least one physical chip.

7. The method of claim 6, wherein the RFID device is attached to the at least one physical chip.

8. The method of claim 6, wherein the identifying information includes information about the denomination of the at least one physical chip.

9. The method of claim 6, wherein causing the at least one processor to execute the plurality of instructions to cause the sensor to collect the identifying information of the at least one physical chip includes causing the at least one processor to execute the plurality of instructions to:

(a) cause an RFID transceiver to scan the at least one RFID device associated with the at least one physical chip; and (b) receive a signal including at least a portion of the identifying information of the at least one physical chip.

10. The method of claim 9, wherein the RFID transceiver is part of a handheld device.

11. The method of claim 9, wherein the signal is an electromagnetic signal transmitted by the at least one RFID device associated with the at least one physical chip, the portion of the identifying information included in the electromagnetic signal including information about a value of the at least one physical chip.

12. The method of claim 1, wherein causing the at least one processor to execute the plurality of instructions to operate with the sensor to collect the identifying information of the at least one physical chip includes causing the at least one processor to execute the plurality of instructions to cause a camera to collect the identifying information of the at least one physical chip.

13. The method of claim 12, wherein the identifying information includes at least one indicium on the at least one physical chip.

14. The method of claim 13, wherein the indicium comprises a machine-readable pattern.

15. The method of claim 14, wherein the pattern is located on an edge of the at least one physical chip.

16. The method of claim 13, wherein the indicium comprises at least one color.

17. A method comprising:

causing at least one processor to execute a plurality of instructions stored in at least one memory device to operate with an optical chip counting device to determine a value of a plurality of physical chips available for wagering on a wagering game played at a gaming table based on machine readable indicia on the physical chips, the physical chips being associated with a balance of a player of the wagering game;

causing the at least one processor to execute the plurality of instructions to determine whether the balance meets a predetermined condition based on the value of the plurality of physical chips; and causing the at least one processor to execute the plurality of instructions to cause a benefit to be provided to the player if the balance meets the predetermined condition.

18. A method comprising:

causing at least one processor to execute a plurality of instructions stored in at least one memory device to operate with an RFID transceiver to determine a value of a plurality of physical chips associated with a wagering game based on a plurality of RFID devices, the wagering game being played at a gaming table, each of the plurality of physical chips including at least one of the RFID devices, the physical chips being associated with a balance of a player of the wagering game;

causing the at least one processor to execute the plurality of instructions to determine whether the balance meets a predetermined condition based on the value of the plurality of physical chips; and causing the at least one processor to execute the plurality of instructions to cause a benefit to be provided to the player if the balance meets the predetermined condition.

19. A system comprising:

a sensor;

at least one processor; and at least one memory device storing a plurality of instructions which, when executed by the at least one processor, cause the at least one processor to operate with the sensor to:

collect identifying information of at least one physical chip available for wagering on a wagering game played at a gaming table, the at least one physical chip being associated with a credit balance;

determine a value of the at least one physical chip based on the collected identifying information;

determine, based at least in part on the value of the at least one physical chip, whether the credit balance meets a predetermined condition; and cause a benefit to be provided if the credit balance meets the predetermined condition.

20. A system, comprising:

at least one processor;

a server device configured to exchange information associated with a value of a credit balance;

a plurality of devices coupled to the server device, each of the plurality of devices being configured to exchange the information associated with the value of the credit balance; and at least one memory device storing a plurality of instructions which, when executed by the at least one processor, cause the at least one processor to operate with the server device and the plurality of devices to:

collect identifying information of at least one physical chip available for wagering on a wagering game played at a gaming table, the at least one physical chip being associated with the credit balance;

determine a value of the at least one physical chip based on the collected identifying information;

determine, based at least in part on the value of the at least one physical chip, whether the credit balance meets a predetermined condition; and cause a benefit to be provided if the credit balance meets the predetermined condition.

21. A method comprising:

causing at least one processor to execute a plurality of instructions to cause identifying information of at least one physical chip to be collected via at least one RFID device associated with the at least one physical chip, the credit balance being associated with a wagering game played at a gaming table;

causing the at least one processor to execute the plurality of instructions to determine a value of the credit balance based on the collected identifying information;

causing the at least one processor to execute the plurality of instructions to determine whether the credit balance meets a predetermined condition based at least in part on the value of the credit balance; and causing a benefit to be provided if the credit balance meets the predetermined condition.

22. The method of claim 21 wherein the benefit comprises:

a form of consideration that motivates a player of the wagering game to cause the credit balance to meet the predetermined condition.

23. The method of claim 21, wherein causing the benefit to be provided if the credit balance meets the predetermined condition comprises:

causing the at least one processor to execute the plurality of instructions to determine the benefit to be provided provide to a player of the wagering game.

24. The method of claim 23, wherein causing the at least one processor to execute the plurality of instructions to determine the benefit to be provided to the player of the wagering game comprises:

causing the at least one processor to execute the plurality of instructions to select a pre-determined benefit associated with the value of the credit balance; and causing the selected pre-determined benefit associated with the value of the credit balance to be provided.

25. The method of claim 21, wherein the identifying information includes information about a denomination of the at least one physical chip.

26. The method of claim 21, which includes an RFID transceiver associated with the wagering game.

27. The method of claim 26, wherein the RFID transceiver is part of a handheld device.

28. The method of claim 26, wherein causing the at least one processor to execute the plurality of instructions to cause the identifying information of the at least one physical chip to be collected via the at least one RFID device associated with the at least one physical chip includes causing the at least one processor to execute the plurality of instructions to:

(a) cause the RFID transceiver to scan the at least one RFID device associated with the at least one physical chip; and (b) receive an electromagnetic signal transmitted by the at least one RFID device associated with the at least one physical chip, the electromagnetic signal including at least a portion of information about the value of the credit balance.

29. A method comprising:

causing at least one processor to execute a plurality of instructions to cause identifying information of at least one physical chip to be collected via at least one optical counting device, the credit balance being associated with a wagering game played at a gaming table;

causing the at least one processor to execute the plurality of instructions to determine a value of the credit balance;

causing the at least one processor to execute the plurality of instructions to determine, based at least in part on the value of the credit balance, whether the credit balance meets predetermined condition; and causing a benefit to be provided if the credit balance meets the predetermined condition.

30. The method of claim 29 wherein the benefit comprises:

a form of consideration that motivates a player of the wagering game to cause the credit balance to meet the predetermined condition.

31. The method of claim 29, wherein causing the benefit to be provided if the credit balance meets the predetermined condition comprises:

causing the at least one processor to execute the plurality of instructions to determine the benefit to be provided to a player of the wagering game.

32. The method of claim 31, wherein causing the at least one processor to execute the plurality of instructions to determine the benefit to be provided to the player of the wagering game comprises:

causing the at least one processor to execute the plurality of instructions to select a pre-determined benefit associated with the value of the credit balance; and causing the selected pre-determined benefit associated with the value of the credit balance to be provided.

33. The method of claim 29, wherein the at least one optical counting device comprises a camera.

34. The method of claim 33, wherein causing the at least one processor to execute the plurality of instructions to determine the value of the credit balance includes causing the at least one processor to execute the plurality of instructions to interpret an image captured by the camera.

35. The method of claim 34, wherein causing the at least one processor to execute the plurality of instructions to interpret the image captured by the camera includes causing the at least one processor to execute the plurality of instructions to interpret the image based on at least one indicium on the at least one physical chip.

36. The method of claim 35, wherein the indicium comprises a machine-readable pattern.

37. The method of claim 35, wherein the indicium comprises at least one color.

38. A method comprising:

causing at least one processor to execute a plurality of instructions stored in at least one memory device to determine a value of at least one chip at a wagering game at least in part by receiving at least a portion of information about the value of the at least one chip via at least one RFID transceiver associated with the wagering game, the RFID transceiver being configured to transmit an electromagnetic signal in a vicinity of at least one RFID device associated with the at least one chip, the electromagnetic signal being capable of causing the at least one RFID device to generate at least the portion of information about the value of the at least one chip, the at least one chip being associated with a credit balance;

causing the at least one processor to execute the plurality of instructions to determine, based at least in part on the value of the at least one chip, whether the credit balance meets a predetermined condition; and providing a benefit if the credit balance meets the predetermined condition.

39. A method comprising:

determining a value of a credit balance via at least one RFID device including an RFID transceiver configured to transmit an electromagnetic signal in a vicinity of at least one RFID device associated with the credit balance, the electromagnetic signal being capable of causing the at least one RFID device to generate at least a portion of information about the value of the credit balance, the credit balance being associated with a wagering game;

determining whether the credit balance meets a predetermined condition based at least in part on the value; and providing a benefit if the credit balance meets the predetermined condition.

* * * * *

UNITED STATES PATENT AND TRADEMARK OFFICE

CERTIFICATE OF CORRECTION

PATENT NO. : 8,231,455 B2
APPLICATION NO. : 11/855523
DATED : July 31, 2012
INVENTOR(S) : Jay S. Walker et al.

It is certified that error appears in the above-identified patent and that said Letters Patent is hereby corrected as shown below:

IN THE CLAIMS

In Claim 8, Column 19, Line 24, replace the first instance of "the" with --a--.
In Claim 11, Column 19, Line 41, replace "a" with --the--.
In Claim 14, Column 19, Line 53, between "the" and "indicium" insert --at least one--.
In Claim 16, Column 19, Line 57, between "the" and "indicium" insert --at least one--.
In Claim 23, Column 21, Lines 20 to 21, delete "provide".
In Claim 29, Column 21, Line 60, between "meets" and "predetermined" insert --a--.
In Claim 36, Column 22, Line 28, between "the" and "indicium" insert --at least one--.
In Claim 37, Column 22, Line 30, between "the" and "indicium" insert --at least one--.

Signed and Sealed this
First Day of January, 2013

David J. Kappos

David J. Kappos
*Director of the United States Patent and Trademark Office*